US007312394B1

(12) United States Patent
Weeks et al.

(10) Patent No.: US 7,312,394 B1
(45) Date of Patent: Dec. 25, 2007

(54) PROTECTIVE DEVICE WITH TAMPER RESISTANT SHUTTERS

(75) Inventors: Richard Weeks, Little York, NY (US); Dejan Radosavljevic, La Fayette, NY (US); Thomas N. Packard, Syracuse, NY (US); Steven C. Thibault, Harwinton, CT (US)

(73) Assignee: Pass & Seymour, Inc., Syracuse, NY (US)

( * ) Notice: Subject to any disclaimer, the term of this patent is extended or adjusted under 35 U.S.C. 154(b) by 0 days.

(21) Appl. No.: 11/609,793

(22) Filed: Dec. 12, 2006

Related U.S. Application Data

(63) Continuation-in-part of application No. 10/900,778, filed on Jul. 28, 2004, now Pat. No. 7,179,992, which is a continuation-in-part of application No. 10/729,685, filed on Dec. 5, 2003.

(51) Int. Cl.
*H01R 13/46* (2006.01)

(52) U.S. Cl. ..... 174/53; 174/58; 174/66; 439/106; 335/18; 361/42

(58) Field of Classification Search ..... 174/53, 174/58, 66; 439/106, 107; 385/76, 92; 361/42–51; 335/165–176, 18
See application file for complete search history.

(56) References Cited

U.S. PATENT DOCUMENTS 4,688,134 A * 8/1987 Freeman et al. ..... 361/45
5,161,240 A * 11/1992 Johnson ..... 361/42
5,510,760 A * 4/1996 Marcou et al. ..... 335/18
5,839,909 A * 11/1998 Calderara et al. ..... 439/137
6,873,231 B2 3/2005 Germain et al.
6,949,994 B2 9/2005 Germain et al.
6,963,260 B2 11/2005 Germain et al.
6,969,801 B2 * 11/2005 Radosavljevic et al. ..... 174/53
6,998,945 B2 * 2/2006 Huang et al. ..... 335/18
7,026,895 B2 4/2006 Germain et al.
7,034,224 B2 * 4/2006 Kim et al. ..... 174/53
7,038,561 B2 * 5/2006 Esty ..... 335/18
7,052,314 B1 * 5/2006 Rose ..... 439/539
7,179,992 B1 * 2/2007 Packard et al. ..... 174/53
2005/0162789 A1 7/2005 Germain et al.
2006/0022777 A1 2/2006 Germain et al.
2006/0055490 A1 3/2006 Germain et al.

* cited by examiner

*Primary Examiner*—Dhiru R. Patel
(74) *Attorney, Agent, or Firm*—Daniel P. Malley; Bond, Schoeneck & King, PLLC

(57) ABSTRACT

The present invention is directed to a protective shutter assembly for use within a cover assembly of an electrical wiring device. The assembly includes a frameless shutter sub-assembly movable between a closed position and an open position. The frameless shutter sub-assembly is configured to move from the closed position to the open position in response to engaging at least one plug blade having a predetermined plug blade geometry. A spring member is disposed within the frameless shutter sub-assembly. The spring member is configured to bias the frameless shutter sub-assembly in the closed position. At least one retainer element is disposed in the frameless shutter sub-assembly. The at least one retainer element being configured to retain the spring member within the frameless shutter sub-assembly. At least one registration member is disposed on the frameless shutter sub-assembly, the at least one registration member being configured to position and align the protective shutter assembly within the cover assembly.

62 Claims, 16 Drawing Sheets

PROTECTIVE DEVICE WITH TAMPER RESISTANT SHUTTERS

CROSS-REFERENCE TO RELATED APPLICATIONS

This is a continuation-in-part of U.S. patent application Ser. No. 10/900,778 entitled "A Protective Device with Tamper Resistant Shutters" filed on Jul. 28, 2004, now U.S. Pat. No. 7,179,992 which is a continuation-in-part of U.S. patent application Ser. No. 10/729,685 entitled "A Protective Device with Tamper Resistant Shutters" filed on Dec. 5, 2003, the contents of which are relied upon and incorporated herein by reference in their entirety, and the benefit of priority under 35 U.S.C. § 120 is hereby claimed.

BACKGROUND OF THE INVENTION

1. Field of the Invention

The present invention relates generally to electrical protection devices, and particularly to electrical protection devices with safety features.

2. Technical Background

As those of ordinary skill in the art understand, an electric circuit comprises many different electrical wiring devices disposed at various locations throughout a structure. These devices include outlet receptacles, which may be combined with other wiring devices such as switches, lighting devices and protective wiring devices. Ground fault circuit interrupters (GFCIs), and arc fault circuit interrupters (AFCIs) are examples of protective devices in electric circuits. Each of the aforementioned protective devices have interrupting contacts for breaking the connection between the line terminals and load terminals when the protective device detects a fault condition. The connection is broken to interrupt the load current and thereby remove the fault condition. Fault conditions include those that result in risk electrocution of personnel, or fire. The outlet receptacles are disposed in duplex receptacles, raceway, multiple outlet strips, power taps, extension cords, light fixtures, appliances, and the like. Duplex receptacles may be configured for installation in outlet boxes. Once installed, a faceplate may be attached to the cover of the outlet receptacle or to the junction box to complete the installation.

Most of these devices have line terminals for connection to the power line, and load terminals for connection to a load. The load terminals include receptacle contacts and feed-thru terminals. The receptacle contacts are configured to accommodate the blades of a plug connector, which are inserted to provide power to a load. Feed-thru terminals, on the other hand, are configured to accommodate wires which are connected to one or more additional receptacles, known as a downstream receptacles. The downstream receptacle may include a string of downstream receptacles that comprise a branch circuit of an electrical distribution system.

One safety issue that heretofore has not been adequately addressed relates to the insertion of foreign objects into receptacle openings. In many cases, young children and toddlers insert objects such as paper clips or screwdriver blades into the receptacle contact openings. Unfortunately, this scenario often results in an electric shock, burns, or electrocution.

In one approach that has been considered, the electrical receptacles in the wiring device are equipped with shuttered openings that prevent the insertion of foreign objects into the receptacle contact openings. One drawback to this approach relates to the ineffectiveness of related art designs. If objects are placed into both openings, the shutter will typically operate, exposing the child to a shock hazard. What is needed is a shutter mechanism that only opens when an actual plug is being inserted into the receptacle.

Another drawback to this approach relates to the complexity of related art shutters. Many shutter designs comprise multiple parts and spring elements that are not integrated into a unitary sub-assembly. The cost and time of assembling the shutter mechanism and the space taken up by their multiple parts limit the usage of these designs. Further, automated environments often generate vibrations and mechanical forces that tend to introduce failure modes. What is needed is a unitary protective shutter assembly suitable for use within automated manufacturing processes.

SUMMARY OF THE INVENTION

The present invention addresses the needs described above. The present invention is directed to is a shutter mechanism that is configured to open only when an actual plug is being inserted into the receptacle. The shutter of the present invention defeats the insertion of one or more foreign objects into receptacle openings. The present invention is also directed to a unitary protective shutter assembly suitable for use within automated manufacturing processes.

One aspect of the present invention is directed to a protective shutter assembly for use within a cover assembly of an electrical wiring device. The assembly includes a frameless shutter sub-assembly movable between a closed position and an open position. The frameless shutter sub-assembly is configured to move from the closed position to the open position in response to engaging at least one plug blade having a predetermined plug blade geometry. A spring member is disposed within the frameless shutter sub-assembly. The spring member is configured to bias the frameless shutter sub-assembly in the closed position. At least one retainer element is disposed in the frameless shutter sub-assembly. The at least one retainer element is configured to retain the spring member within the frameless shutter sub-assembly. At least one registration member is disposed on the frameless shutter sub-assembly, the at least one registration member being configured to position and align the protective shutter assembly within the cover assembly.

In another aspect, the present invention is directed to an electrical wiring device assembly that includes a cover assembly having at least one set of receptacle openings configured to accommodate a set of plug blades having a predetermined plug blade geometry. The cover assembly also includes at least one cover registration structure. A plurality of receptacle contacts are disposed in the device, each of the plurality of receptacle contacts being in communication with a corresponding one of the at least one set of receptacle openings. A frameless protective shutter assembly is disposed in the cover assembly. The frameless protective shutter assembly is configured to move from a closed position to an open position in response to engaging at least one of the set of plug blades. The plurality of receptacle contacts are accessible to the set of plug blades in the open position. The frameless protective shutter assembly includes a spring member and at least one retainer element configured to retain the spring member within the frameless protective shutter assembly. The frameless protective shutter assembly also includes at least one shutter assembly registration member configured to mate with the at least one cover registration structure.

In yet another aspect, the present invention is directed to a method for assembling an electrical wiring device. The method includes the step of providing an electrical wiring device having a cover assembly including at least one set of receptacle openings configured to accommodate a set of plug blades having a predetermined plug blade geometry. The cover assembly also includes at least one cover registration structure. A frameless protective shutter assembly is provided. The assembly is configured to move from a closed position to an open position in response to engaging the set of plug blades. A spring member is disposed in the protective shutter assembly. The frameless protective shutter assembly includes at least one retainer element configured to retain the spring member within the frameless protective shutter assembly. The frameless protective shutter assembly also includes at least one shutter assembly registration member. The frameless protective shutter assembly is positioned within the cover assembly. The at least one shutter assembly registration member is coupled to the at least one cover registration structure. The frameless protective shutter assembly is disposed within the cover assembly in substantial alignment with the at least one set of receptacle openings.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

DETAILED DESCRIPTION

Figure 1:
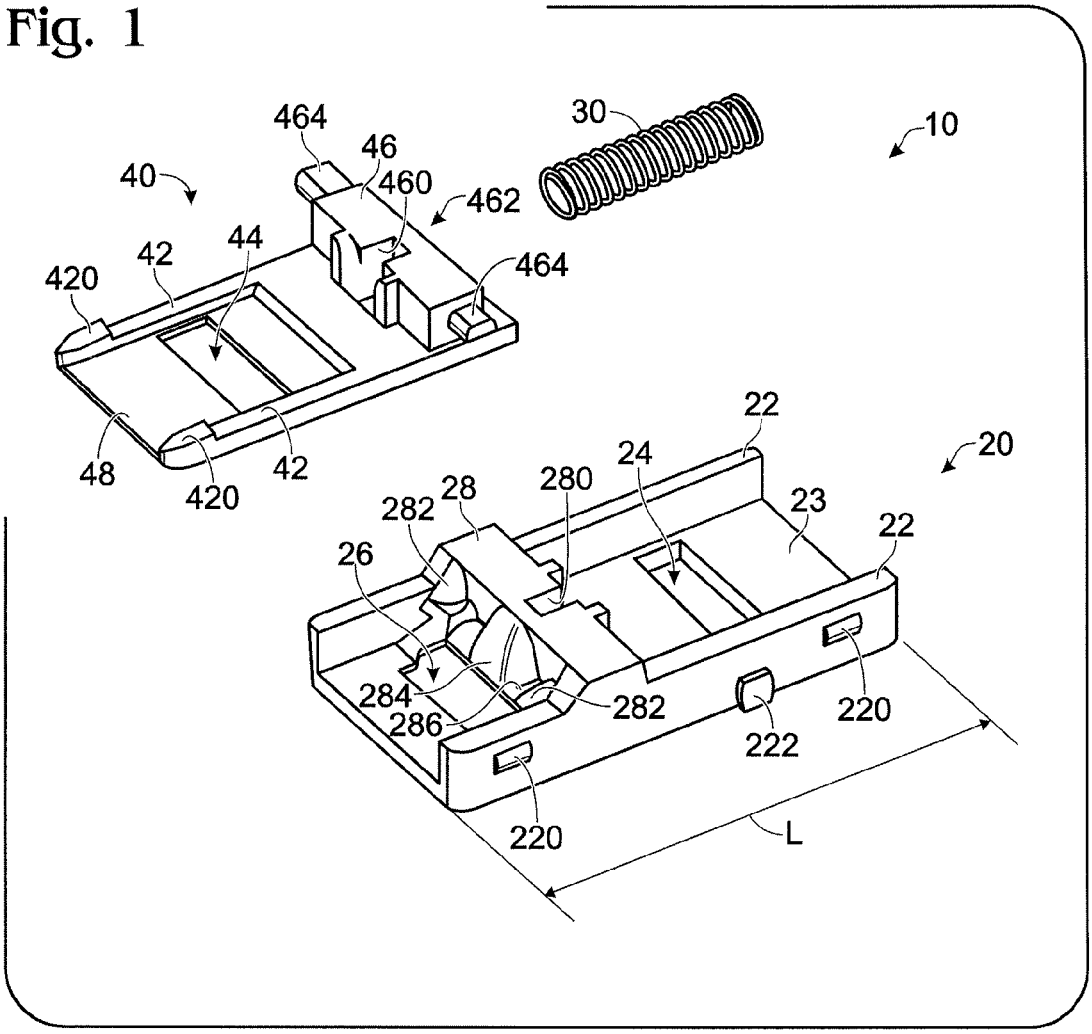
FIG. 1 is an exploded view of a protective shutter assembly in accordance with one embodiment of the present invention.

Reference will now be made in detail to the present exemplary embodiments of the invention, examples of which are illustrated in the accompanying drawings. Wherever possible, the same reference numbers will be used throughout the drawings to refer to the same or like parts. An exemplary embodiment of the protective shutter assembly of the present invention is shown in FIG. 1, and is designated generally throughout by reference numeral 10.

As embodied herein and depicted in FIG. 1, an exploded view of a protective shutter assembly 10 in accordance with one embodiment of the present invention is disclosed. The protective shutter assembly 10 is a frameless mechanism that includes a lower shutter member 20 and an upper shutter member 40. A spring member 30 is disposed between lower shutter 20 and upper shutter 40.

The lower shutter 20 includes side rails 22 and a base member 23 disposed therebetween. Base 23 has a first hot contact aperture 26 and a neutral contact aperture 24 formed therein. A transverse hot blade contact structure 28 is disposed between rails 22 and spans a portion of the first hot contact aperture 26.

Transverse contact structure 28 includes a spring retainer pocket 280, upper rail guides 282 and blade contact ramp 284. As the name suggests, upper rail guides 282 allows the rails 42 of the upper shutter to slide therebetween, allowing shutter 10 to move between the open position and the closed position. Rail guides 282 also have a rail stop function. Upper shutter rail stop members 420 abut rail guides 282 to prevent upper shutter 40 from disengaging lower shutter 20 due to the force exerted by spring 30 in the closed position.

Transverse contact structure 28 includes a blade detection geometry implemented by hot blade contact ramp 284 and ramp base 286. The hot blade contact ramp 284 is disposed in a central portion of structure 28. Ramp 284 has a predetermined width and includes contoured surfaces that recede into the face of structure 28. Those of ordinary skill in the art will recognize that the contoured surfaces will cause foreign objects having a width that is less than the predetermined width of ramp 284, such as paper clips and the like, to slide off the ramp and strike the base 286. As a result, a perpendicular force relative to the longitudinal axis of base 23 will be applied by the person wielding the object and the object will be blocked. The predetermined width of ramp 284, of course, is selected in accordance with the geometry of a proper plug blade. Those of ordinary skill in the art will understand that the contoured surface of ramp 284 may be of any suitable shape, such as an arcuate shape, a pointed shape, etc.

The upper shutter member 40 includes guide rails 42 having a base member 48 disposed therebetween. As noted above, the guide rails include a stop member 420 that is configured to abut lower shutter rail guides 282 to prevent the shutters (20, 40) from disengaging due to the force exerted by the spring 30. An upper shutter hot contact aperture 44 is disposed in base member 48.

Upper shutter member 40 also includes a transverse neutral blade contact structure 46 disposed at one end thereof. Transverse neutral blade contact structure 46 includes a spring retainer pocket 460, guide rails 42 and, like the lower shutter transverse contact structure 28, a blade detection geometry implemented by neutral blade contact ramp 462 and ramp base 465. The neutral blade contact ramp 462 is disposed at an end portion of shutter 40. In the closed position, neutral blade contact ramp 462 covers the lower shutter neutral aperture 24. Ramp 462 has a predetermined width and includes contoured surfaces that recede into the face of structure 46. Again, those of ordinary skill in the art will recognize that the contoured surfaces will cause foreign objects having a width that is less than the predetermined width of ramp 462, such as paper clips and the like, to slide off the ramp and strike the base 465. As a result, a perpendicular force relative to the longitudinal axis of base 465 will be applied by the person wielding the object and the object will be blocked. The predetermined width of ramp 462 is selected in accordance with the geometry of a proper plug blade. Those of ordinary skill in the art will understand that the contoured surface of ramp 462 may be of any suitable shape, such as an arcuate shape, a pointed shape, etc.

The protective shutter assembly 10 includes registration members disposed on the frameless shutter sub-assembly. The registration members are configured to position and align the protective shutter assembly 10 within the cover assembly of an electrical wiring device. The lower shutter includes a lower shutter longitudinal registration members 222 and the upper shutter includes an upper shutter longitudinal registration members 464. As their names suggest, the lower shutter longitudinal registration members 222 and the upper shutter longitudinal registration members 464 are configured to correctly align and position the protective shutter assembly 10 within the cover assembly at a position along a longitudinal axis of the protective shutter assembly. Protective shutter assembly 10 also includes snap-in registration members 220. The snap-in elements, of course, allows the shutter assembly 10 to be snapped, as a unit, into the cover assembly, provided that the lower shutter longitudinal registration member 222 and the upper shutter longitudinal registration member 464 are correctly registered with a corresponding registration structure within the cover assembly.

Note that the protective shutter assembly 10 is characterized by a length (L) that is approximately equal to an inch. In a 15A embodiment, the length (L) is approximately equal to 0.860". In a 20A device, the length (L) is approximately equal to 1.060".

Figure 2:
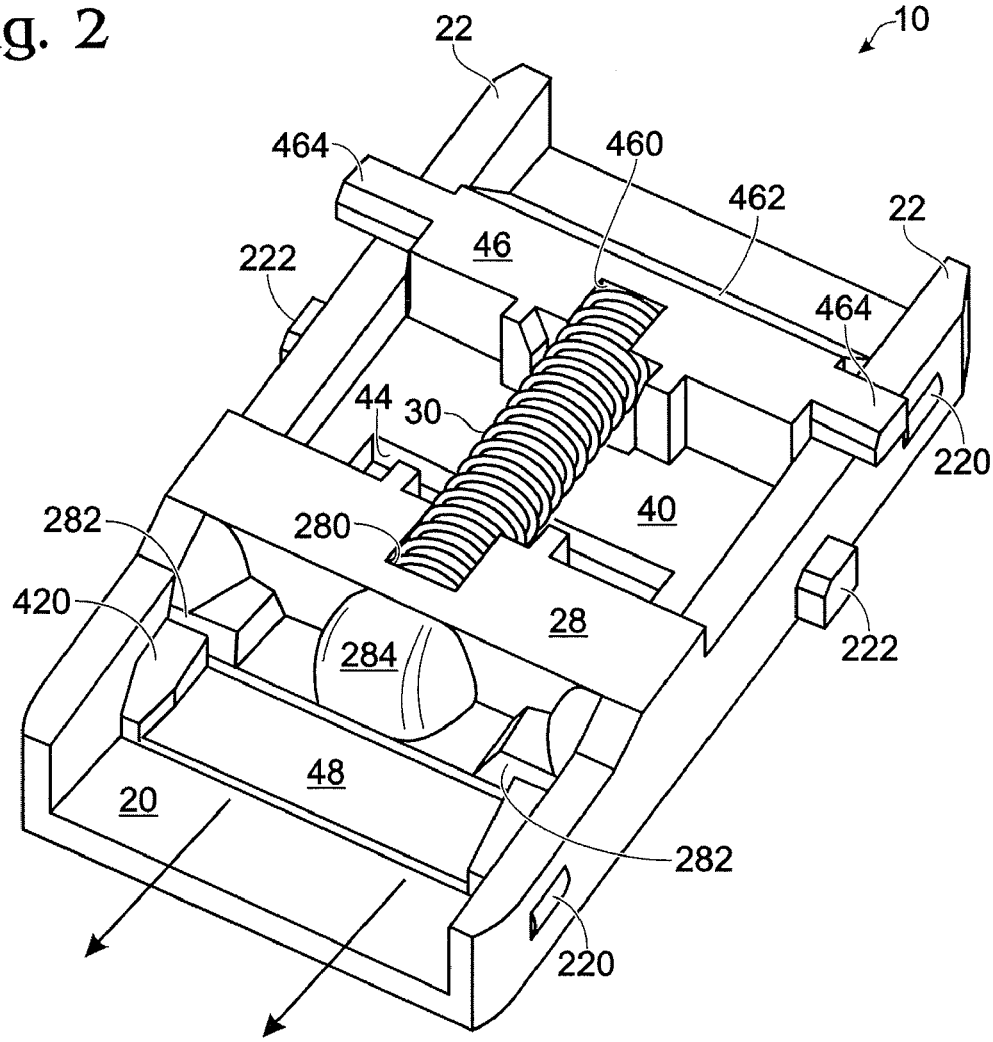
FIG. 2 is a perspective of the protective shutter assembly shown in FIG. 1.

Referring to FIG. 2, a perspective of the protective shutter assembly 10 shown in FIG. 1 is shown. When assembled, the upper shutter 40 is inserted into lower shutter 20 until stop members 420 extend beyond rail guides 282 and snap into place. This position represents the closed position, wherein upper transverse structure covers neutral aperture 24 and upper base 48 covers hot aperture 26. The lower shutter member 20 and the upper shutter member 40 are movable relative to each other from the closed position to the open position in response to being simultaneously engaged by the hot plug blade and the neutral plug blade of an electrical plug. To facilitate this movement, shutter members (20,40) are made from a family of plastics having natural lubricity. These include nylon 6-6, Delrin, and Teflon. Shutter members (20,40) may be made from a substrate on which these materials are coated, the substrate having a differing flammability or flexural characteristic.

If a foreign object having a width substantially the same as a hot plug blade is inserted into the hot receptacle opening, the shutter assembly remains closed. The foreign object causes ramp 284, and therefore, lower shutter 20, to move. However, this foreign object insertion does not cause upper shutter 40 to move relative to shutter 20. As a result, the foreign object inserted into the hot receptacle opening strikes lower base member 48 of the upper shutter. On the other hand, if a foreign object having a width substantially the same as a neutral plug blade is inserted into the neutral receptacle opening, transverse structure 46 will move upper shutter 40 but not move lower shutter 20. Accordingly, the lower base member 23 does not move and the neutral aperture 24 (See FIG. 1) is not exposed. Thus, the foreign object inserted into the neutral receptacle opening strikes lower base member 23.

Only when the hot plug blade and the neutral plug blade of an electrical plug simultaneously engage ramp 284 and ramp 462, respectively, will the lower shutter member 20 and the upper shutter member 40 move relative to each other from the closed position to the open position. In the open position, the lower hot aperture 26 is aligned with the upper hot contact aperture 44 and, the inward edge of the lower neutral contact aperture 24 is substantially aligned with the outer edge of ramp 462. In this position, the lower shutter 20 and the upper shutter 40 allow the plug contact blades to pass through the protective shutter 10 and engage the contacts disposed in the interior of the electrical wiring device.

In another embodiment, the predetermined electrical plug geometry that opens the shutters may include only some of the characteristics that have been described. The geometry may include just one or more of the following: two plug blades separated by a predetermined distance, plug blades contacting the two blade structures simultaneously, a neutral plug blade having a predetermined width, or a hot plug blade having a predetermined width. Plug blade width will not matter if ramps 284 and/or 462 approach the widths of their respective contact structures.

The movement of the upper shutter 40 and the lower shutter 20 is effected by spring member 30. The spring member 30 is configured to bias the frameless shutter sub-assembly, i.e., lower shutter 20 and upper shutter 40, in the closed position. Spring member 30 is compressed further in the open position and, therefore, opposes movement of the frameless shutter sub-assembly from the closed position to the open position. Accordingly when the electrical plug is removed, the spring moves the frameless shutter sub-assembly from the open position to the closed position. Stated differently, only a single spring is necessary to effect the closed position of the shutter assembly.

As alluded to above, the protective shutter assembly 10 includes a spring retainer mechanism. The spring retainer mechanism includes lower shutter retainer pocket 280 and upper shutter retainer pocket 460. The spring retainer mechanism is configured to retain the spring member 30 within the frameless shutter sub-assembly and substantially prevent the spring member from being separated from the frameless shutter sub-assembly. As those of ordinary skill in the art will appreciate, the protective shutter assembly 10 may be dropped and/or exposed to vibrational and/or mechanical forces during automated assembly. As shown in FIG. 1, retainer pockets (280, 460) are equipped with retainer lips that prevent the spring member from being jarred loose.

Figure 3:
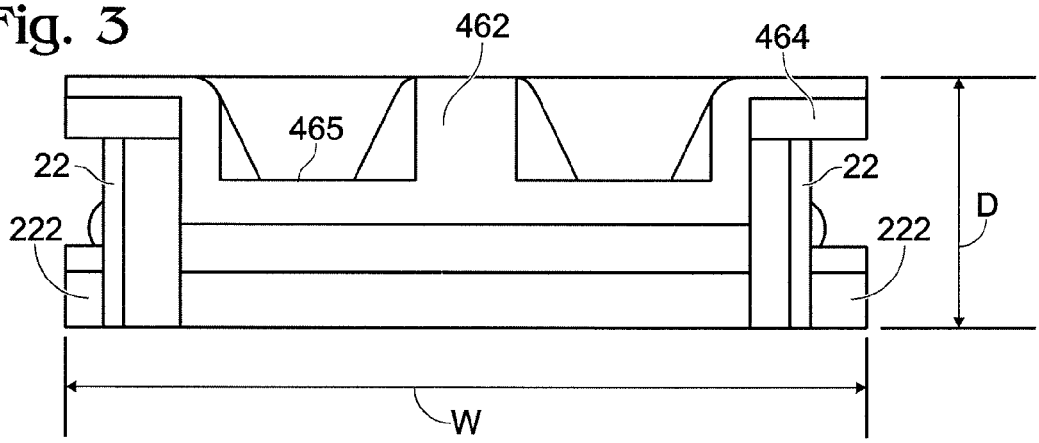
FIG. 3 is an elevation view of the protective shutter assembly shown in FIG. 1.
Figure 4:
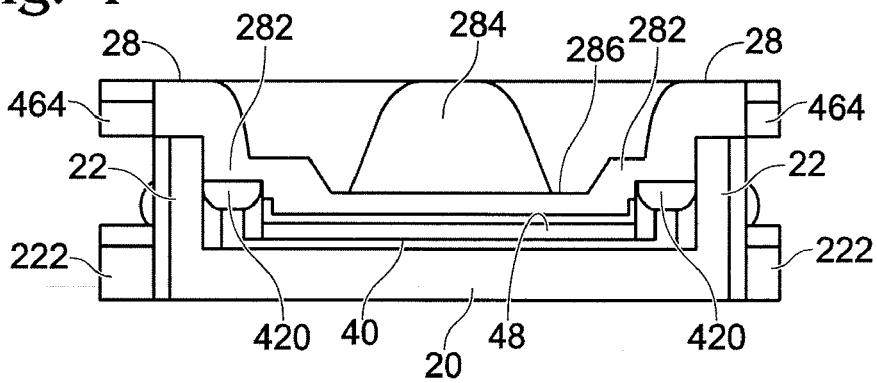
FIG. 4 is another elevation view of the protective shutter assembly shown in FIG. 1.

Referring to FIG. 3 and FIG. 4, elevation views of each end of the protective shutter assembly 10 are provided. FIG. 3 shows the upper shutter ramp 462. Upper shutter registration members 464 protrude over lower shutter rails 22 approximately the same distance lower shutter registration members 222 extend outwardly from rails 22. The blade detection features of ramp 462 were discussed in detail above.

As shown in FIG. 3, the protective shutter assembly 10 is characterized by a width (W) and a depth dimension (D). In one embodiment of the present invention the width (W) is less than or equal to 0.5 inches. In one implementation, the width (W) is approximately 0.460 inches. The depth, or thickness, of the device is typically less than or equal 0.2 inches. In one implementation the depth (D) is approximately equal to 0.170 inches.

The elevation view in FIG. 4 shows the lower shutter ramp 284 in detail. The blade detection features of ramp 284 were discussed in detail above. FIG. 4 illustrates the base portion 48 of shutter 40 disposed between ramp base 286 and the bottom of lower shutter 20. Stop member 420 is also shown in the locked position relative to rail guides 282.

Figure 5:
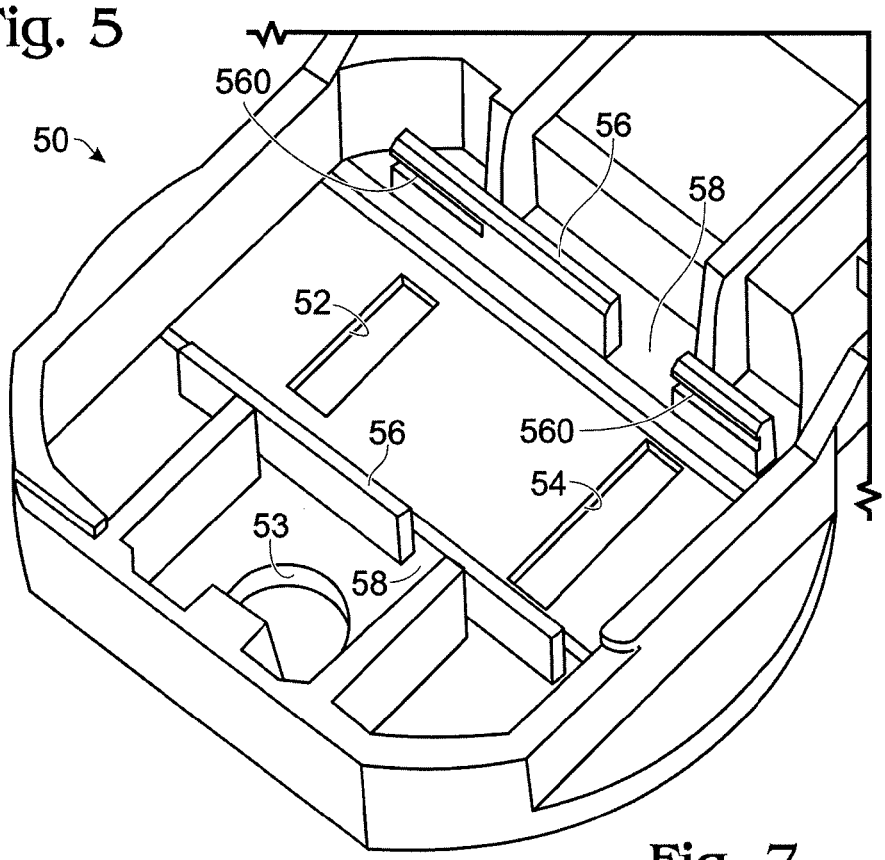
FIG. 5 is a detail view of a cover assembly in accordance with an embodiment of the present invention.

As embodied herein and depicted in FIG. 5, a detail view of a cover assembly 50 in accordance with an embodiment of the present invention is disclosed. The cover assembly 50 is shown to include hot receptacle opening 52 and neutral receptacle opening 54. Those of ordinary skill in the art will understand that the shape and size of the receptacle openings is determined by the geometry of the type of service, i.e., 15A, 20A, etc., and the corresponding plug blades. Of course, the cover 50 mates with a wiring device housing that includes a plurality of receptacle contacts. The hot 52, neutral 54, and ground 53 openings are in communication with their corresponding receptacle contacts in the open position. The electrical plug may include pins instead of blades in which case the corresponding receptacle openings are circular instead of rectangular. Ramps (286,462) are then configured to allow predetermined pin shapes to open the shutter assembly.

Cover assembly 50 includes a pair of cover registration structures 560, each including a registration alignment key 58 disposed therein. Each alignment key 58 accommodates a lower shutter longitudinal registration member 222 and an upper shutter longitudinal registration member 464. The position of alignment key 58 ensures that the protective shutter assembly 10 is positioned within cover assembly 50 such that the hot aperture 26, neutral aperture 24, and the ramp structures (284, 462) and base portions (23,48) are correctly aligned with the receptacle openings (52, 54).

Each registration structure 560 includes a registration groove 560 that is configured to mate with snap-in registration member 220 (See FIG. 1). As discussed above in some detail, registration member 220 is configured to snap into registration groove 560 to couple the frameless protective shutter assembly 10 to the cover assembly 50.

Figure 6:
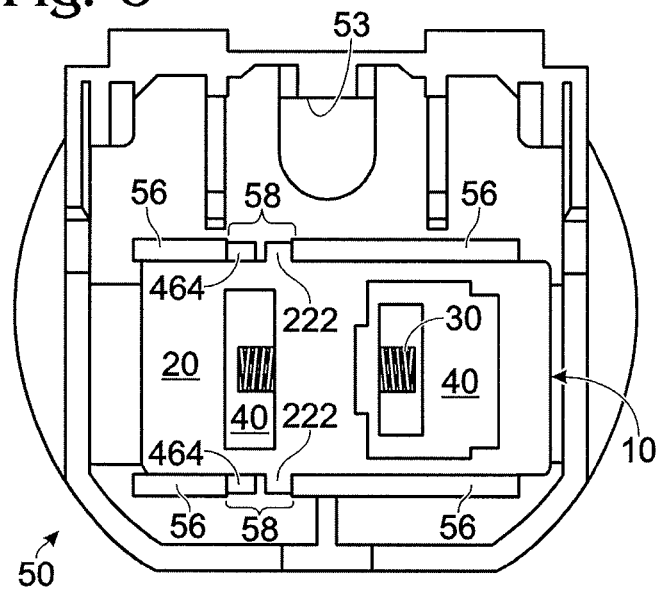
FIG. 6 is a plan view of an internal portion of the cover assembly shown in FIG. 5 with the protective shutter assembly of FIG. 1 disposed therein.

FIG. 6 is a plan view of the cover assembly 55 with the protective shutter assembly 10 disposed therein. While the Figure is self-explanatory, there are a few features worthy of further explanation. Note that lower shutter longitudinal registration member 222 and the upper shutter longitudinal registration member 464 are slightly offset one from the other within alignment key 58. The shutter assembly is shown in the closed position. Due to spring 30 being in a compressed state, the registration members 222 and 464 occupy alignment key 58 so that there is little or no longitudinal play in the shutter assembly with respect to the cover. As noted above, when the hot plug blade and the neutral plug blade of an electrical plug simultaneously engage ramp 284 and ramp 462, respectively, the lower shutter member 20 and the upper shutter member 40 move relative to each other from the closed position to the open position. FIG. 6 illustrates that lower shutter 20 also moves within the cover assembly 50. When the shutter assembly 10 is opened, the position of the lower shutter longitudinal registration member 222 and the upper shutter longitudinal registration member 464 within alignment key 58 are exchanged. However, alignment key 58 limits the movement of the lower shutter 20 and the upper shutter 40.

Figure 7:
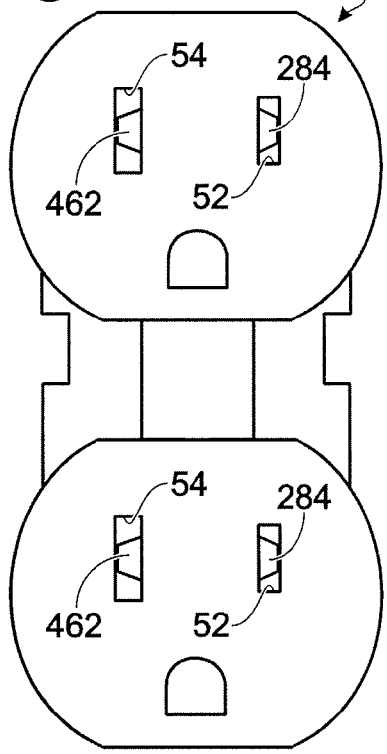
FIG. 7 is a plan view of an external portion of the cover assembly shown in FIG. 5 with the protective shutter assembly of FIG. 1 disposed therein.

Referring to FIG. 7, a plan view of an external portion of the cover assembly 50 is shown with the protective shutter assembly 10 disposed therein. As noted above, the registration features of the present invention eliminate any possibility that shutter assembly 10 will be improperly aligned within the cover 50. Shutter ramp 284 is correctly aligned with hot receptacle opening 52 and shutter ramp 462 is correctly aligned with neutral receptacle opening 54.

Figure 8:
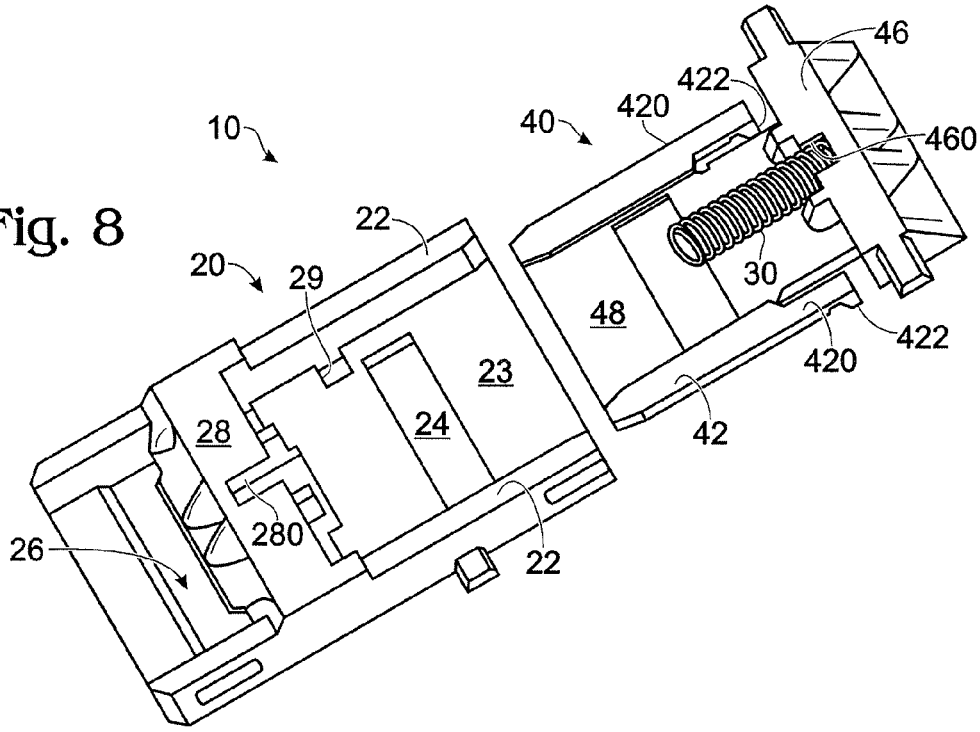
FIG. 8 is an exploded view of a protective shutter assembly in accordance with another embodiment of the present invention.

As embodied herein and depicted in FIG. 8, an exploded view of a protective shutter assembly 10 in accordance with another embodiment of the present invention is disclosed. The embodiment shown in FIG. 8 is a shutter assembly that may be employed in a 15A wiring device and is, in fact, very similar to the device described above. The differences between the shutter assembly depicted in FIGS. 1-7 and the embodiment depicted in FIG. 8 relates to the stop mechanism. In the instant embodiment, lower shutter member 20 includes stop apertures 29 disposed in base 23 inside guide rails 22. Upper shutter member 40 includes stopping arms 420 which extend from base member 48 toward transverse member 46. Stopping arms 420 are equipped with downwardly extending stop members 422, which are configured snap into apertures 29 when the two shutters are assembled together during manufacturing assembly. Spring 30 then urges stop members 422 to travel in apertures 29 to the closed position.

When the lower shutter member 20 and the upper shutter member 40 move toward each other when going from the closed position to the open position, stop members 422 slide in the reverse direction in apertures 29, moving toward lower transverse member 28.

Figure 9:
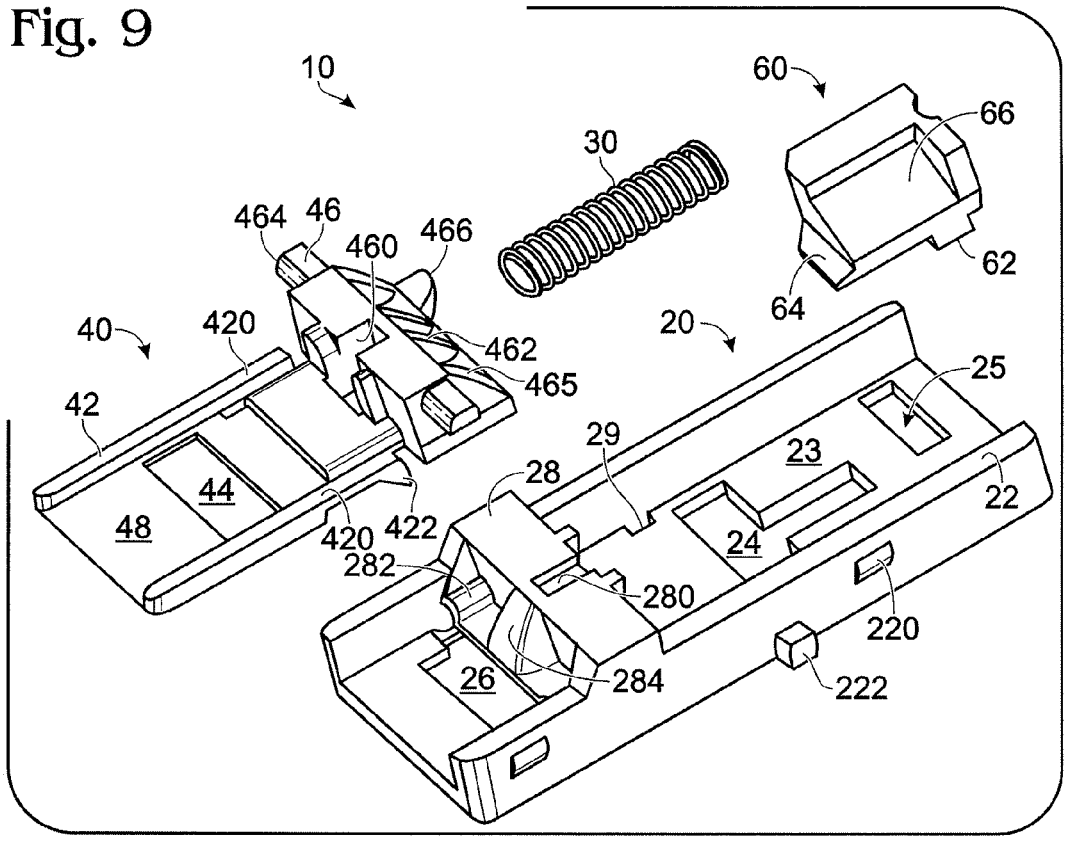
FIG. 9 is an exploded view of a protective shutter assembly in accordance with yet another embodiment of the present invention.

As embodied herein and depicted in FIG. 9, an exploded view of a protective shutter assembly in accordance with yet another embodiment of the present invention is disclosed. The embodiment shown in FIG. 9 is a shutter assembly that may be employed in a 20A wiring device. The hot and neutral receptacle openings are perpendicular to each other so as to accommodate the blades of 20A plugs. The neutral receptacle opening for the 20A outlet receptacle may be in the shape of a "t-slot" so that either 15A plugs (parallel blades) or 20A plugs (perpendicular blades) may be inserted. Most of the mechanisms employed in the 15A shutter assembly depicted in FIGS. 1-7 are employed herein. The differences between the 20A shutter assembly and the 15A shutter assembly depicted in FIGS. 1-7 relate to the 20A neutral blade shutter.

Like the 15A shutter assembly, the 20A protective shutter assembly 10 is a frameless mechanism that includes a lower shutter member 20 and an upper shutter member 40. A spring member 30 is disposed between lower shutter 20 and upper shutter 40. The lower shutter 20 includes side rails 22 and a base member 23 disposed therebetween. Base 23 has a first hot contact aperture 26 and a neutral contact aperture 24 formed therein (note that aperture 24 is shaped as a t-aperture to be able to accommodate either a 15A or 20A plug when the shutter assembly is in the open position). A transverse hot blade contact structure 28 is disposed between rails 22 and spans a portion of the first hot contact aperture 26. Transverse contact structure 28 includes a spring retainer pocket 280, upper rail guides 282 and blade contact ramp 284. The blade contact ramp 284 is equipped with a blade detection geometry implemented by hot blade contact ramp 284 and ramp base 286.

The upper shutter member 40 includes guide rails 42 having a base member 48 disposed therebetween. As noted above, the guide rails 42 include a stop member 420 that is configured to abut lower shutter rail guides 282 to prevent the shutters (20, 40) from disengaging due to the force exerted by the spring 30. An upper shutter hot contact aperture 44 is disposed in base member 48. Upper shutter member 40 also includes a transverse neutral blade contact structure 46 disposed at one end thereof. Transverse neutral blade contact structure 46 includes a spring retainer pocket 460, guide rails 42 and, like the lower shutter transverse contact structure 28, a blade detection geometry implemented by neutral blade contact ramp 462 and ramp base 465.

Unlike the 15A shutter assembly, the 20A embodiment includes a slot 25 disposed in the base portion 23 of the lower shutter 20. A 20A shutter member 60 is disposed in the slot 25. The 20A shutter member 60 is operable in conjunction with the upper shutter member 40 and is employed to block a portion of the T-slot receptacle opening in the closed position. The 20A shutter member 60 includes an insert member 62, tooth portion 64, and ramp portion 66. The insert portion 62 is configured to snap into slot 25 but is also slideable along the axis of slot 25. The upper transverse member 46 of shutter 40 includes a cam member 466 that is configured to engage the tooth portion 64. The ramp portion 66 aligns with t-slot opening 54, being configured to engage a portion of a 20A neutral plug blade. The operation of the 20A shutter mechanism 60 will be described below.

Figure 10:
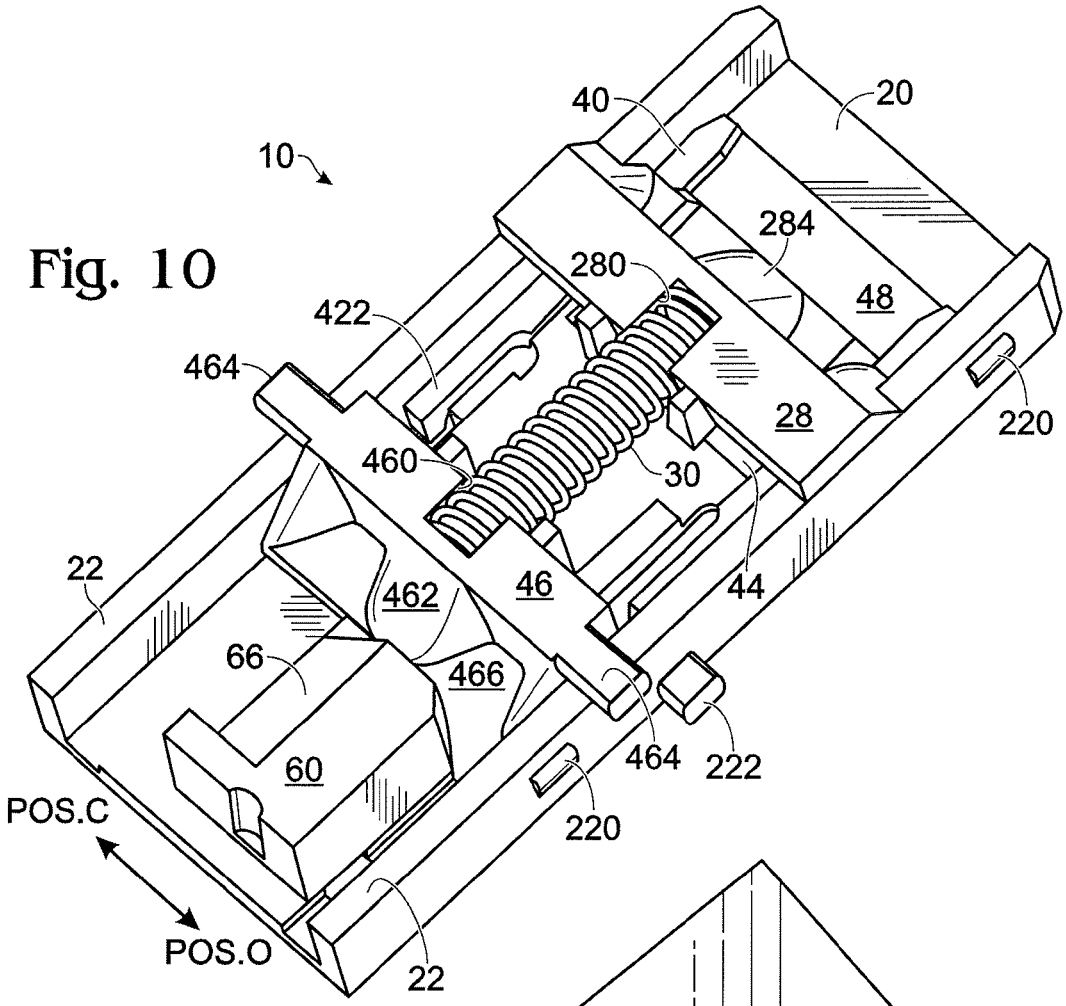
FIG. 10 is a perspective of the protective shutter assembly shown in FIG. 9.

FIG. 10 is a perspective of the protective shutter assembly shown in FIG. 9. When shutter 40 is in the closed position, the resulting interference between cam 466 and tooth portion 64 locks shutter mechanism 60 in the closed position. As previously described in detail, foreign objects inserted into either the hot receptacle opening 52 or the 15A portion of the t-slot opening 54 cannot move upper shutter 40 (or lower shutter 20) to their open positions. Accordingly, a foreign object inserted in the 20A portion of t-slot opening 54 cannot open shutter mechanism 60.

In operation, an edge portion of a 20A neutral plug blade initially engages ramp 462. Since the edge portion is aligned to the ramp 462 by t-slot opening 54, the edge portion cannot slide off of the ramp as would a foreign object. Thus the edge portion is able to move shutter 40 toward the open position as it is being inserted. At the same time, cam 466 moves away from tooth portion 64. Since shutter 60 is no longer locked, the side portion of the 20A neutral plug blade engages ramp 66 and urges shutter 60 from "Pos. C" towards "Pos. O" (FIG. 10). This unblocks a portion of the T-slot opening. At substantially the same instant in time, the hot plug blade engages ramp 284. Again, the lower shutter member 20 and the upper shutter member 40 are movable relative to each other from the closed position to the open position in response to being simultaneously engaged by a hot plug blade and the neutral plug blade. The three shutters are configured to allow a 20A plug to make electrical connection with the receptacle contacts when in the open position. When shutter 40 returns to the closed position, the cam member 466 is configured to urge the 20A shutter member 60 in the direction from "Pos. O" to "Pos. C". Shutters 40 and 60 thereby close the t-slot opening. As has been described at length, the closed position of the 20A shutter assembly comprised of shutters 20, 40 and 60 depend from a single spring (spring 30).

Figure 11:
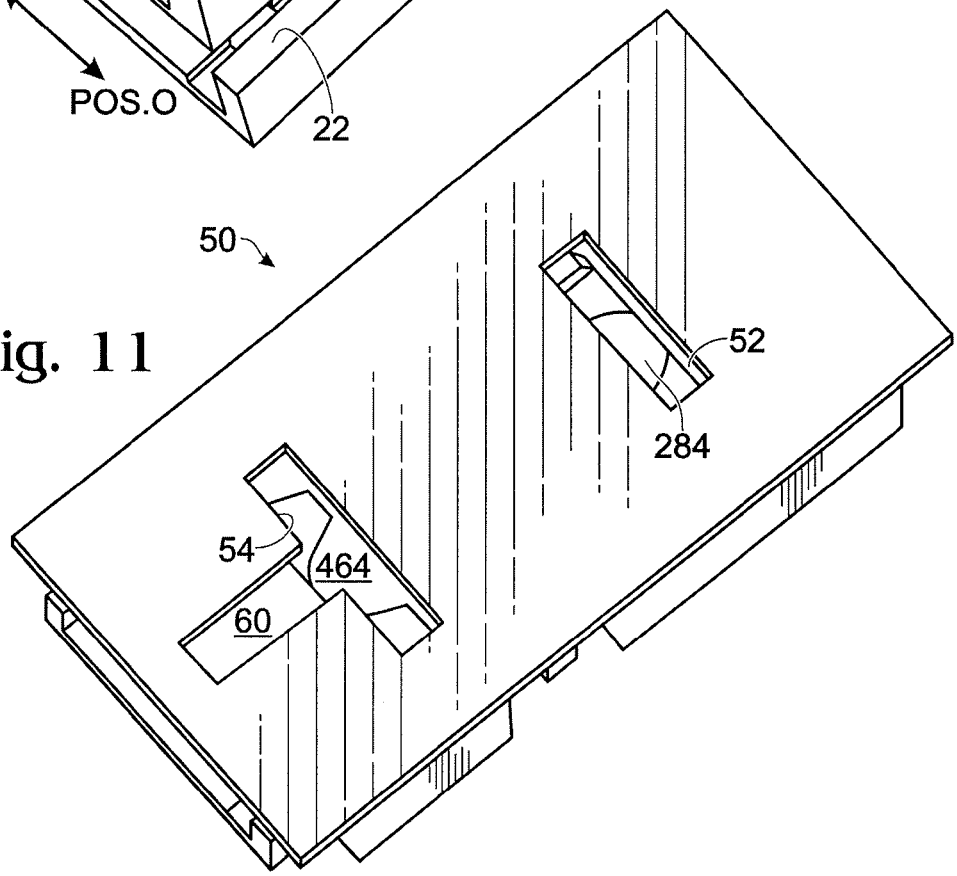
FIG. 11 is a plan view of an external portion of a cover assembly shown with the protective shutter assembly of FIG. 9 disposed therein.

Referring to FIG. 11, a plan view of an external portion of a cover assembly 50 is shown with the protective shutter assembly of FIG. 9 disposed therein. The registration system employed in the 15A system is applicable to the 20A embodiment. Accordingly, shutter ramp 284 is correctly aligned with hot receptacle opening 52 and the neutral shutter ramps 464, 60 are correctly aligned within T-slot 54.

Figure 12:
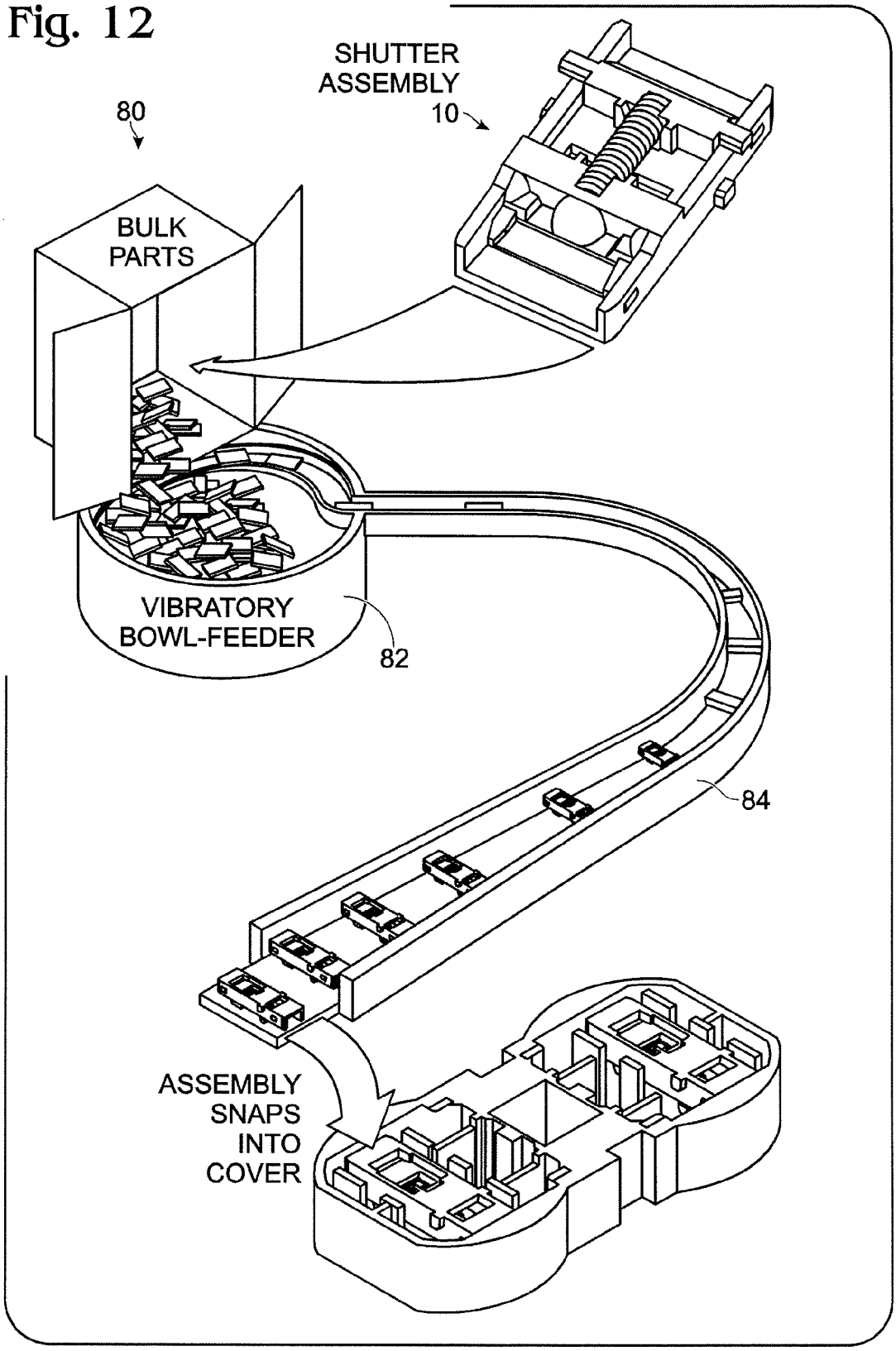
FIG. 12 is diagrammatic depiction of an automated process for assembling the protective shutter assemblies of the present invention within a cover of an electrical wiring device.

As embodied herein and depicted in FIG. 12, a diagrammatic depiction of an automated process 80 for assembling protective shutters 10 within an electrical wiring device cover 50 is disclosed. One of the drawbacks of related art devices relates to their unsuitability for automated assembly. Many such devices includes framing members, multiple spring elements, and other parts that complicate an automated assembly process.

Turning to FIG. 12, protective shutter assemblies 10 are provided in bulk and are transferred to a vibratory bowl feeder 82. During the loading process the shutter assemblies 10 may be subjected to mechanical forces as they are dropped into bowl feeder 82. The bowl feeder 82 itself applies vibrational forces to align and direct the shutters into the feeder line 84. Note that because of the frameless two-piece design and the spring retaining features, the mechanical and/or vibrational forces applied to the shutter assembly 10 do not adversely impact shutter assembly reliability.

When each individual shutter reaches the end of the feeder line 84, a robotic assembly tool (not shown) takes the shutter assembly 10 from the feeder line 84 and positions it within the cover assembly. The robotic assembly tool is designed and programmed to couple the shutter 10 to cover 50 by mating the shutter assembly registration members (220, 464, 222) to their corresponding cover registration structures (56, 58, 560) as shown in FIG. 6. The registration and alignment features of the present invention facilitate the automated disposition of the frameless protective shutter assembly 10 within the cover assembly in correct alignment with the receptacle openings.

Figure 13:
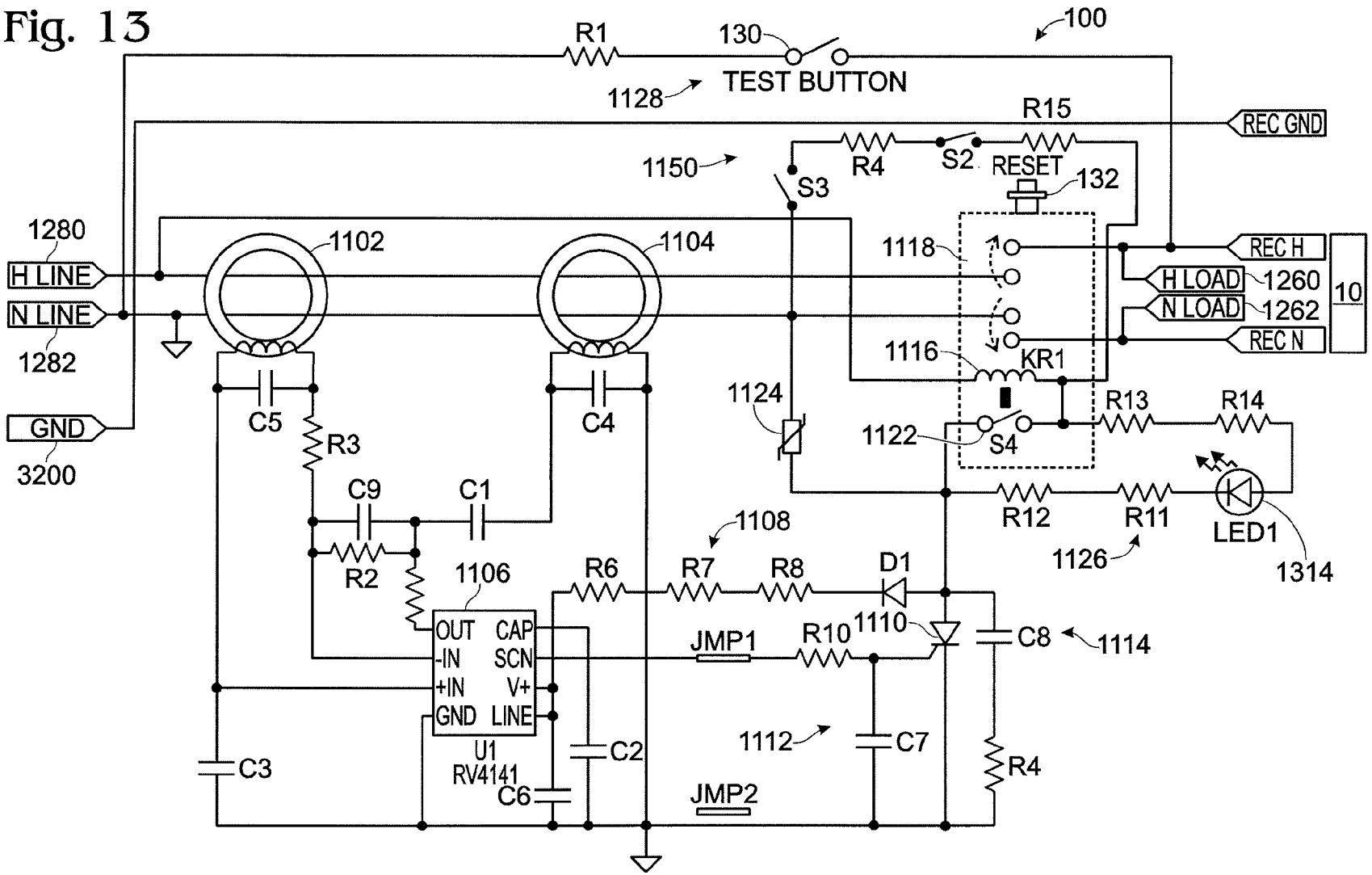
FIG. 13 is a schematic diagram of a ground fault circuit interrupter in accordance with an embodiment of the present invention.

As embodied herein and depicted in FIG. 13, a schematic diagram of a ground fault circuit interrupter 100 in accordance with an embodiment of the present invention is disclosed. Moving from left to right in the schematic, it is seen that GFCI 100 includes hot line male terminal element 1280, neutral line receptacle blade 1282, and ground receptacle blade 3200. On the load side of device 12, there is hot load male terminal element 1260, neutral load male terminal element 1262 and a pair of user accessible receptacles, each including a hot receptacle terminal and a neutral receptacle terminal. In accordance with the present invention, the hot receptacle terminal and the neutral receptacle terminal are coupled to and protected by shutter assembly 10.

The ground fault circuitry includes a differential transformer 1102 which is configured to sense load-side ground faults. Transformer 1104 is configured as a grounded neutral transmitter and is employed to sense grounded-neutral fault conditions. Both transformers are disposed in toroid assembly L1. Both (LINE) conductors pass thru the sensors. Differential transformer 1104 senses currents from HOT to GROUND but not HOT to NEUTRAL. Both differential transformer 1102 and grounded-neutral transformer 1104 are coupled to detector integrated circuit 1106. Detector 1106 is powered by a power supply circuit 1108 connected to pin $V^+$ on detector 1106. The detector output, provided on output pin SCR, is connected to the control input of SCR 1110. Filter 1112, comprising resistor R10 and capacitor C7, low-pass filter the detector output signal. GFCI 100 also includes a snubber circuit 1114 that includes resistor R4 and capacitor C8. Snubber circuit 1114 prevents voltage transients from triggering SCR 1110.

When SCR 1110 is turned ON, solenoid 1116 is energized, actuating circuit interrupter 1118. Solenoid 1116 remains energized for a time period that is typically less than about 25 milliseconds. Circuit interrupter 1118 trips, resulting in the line terminals being disconnected from respective load terminals. After the fault condition has been eliminated, the circuit interrupter 1118 may be reset by way of reset button 132. In one embodiment, the reset mechanism actuated by reset button 132 is purely mechanical in nature and does not include any electrical contacts for test initiation.

GFCI 100 addresses certain end of life conditions by denying power to the load when the device is unable to function. As an example of an end-of-life condition, solenoid 1116 is susceptible to burn-out if SCR 1100 becomes shorted out, or is permanently turned ON. Solenoid 1116 may burn out if it is energized for more than about 1 second. Once the solenoid 1116 burns out, the circuit interrupter 1118 is incapable of being tripped. Solenoid burn-out prevention is provided by auxiliary switch 1122.

Auxiliary switch 1122 is configured to open when the circuit interrupter 1118 is in the tripped position. If SCR 1110 is shorted out, or permanently ON, auxiliary switch 1122 ensures that solenoid 1116 is not permanently connected to a current source. The user may attempt to reset GFCI 100 by depressing the reset button 1120, but the circuit interrupter 1118 will immediately trip in response to the current flowing through the solenoid 1116. Because the trip mechanism 1118 is coupled to the auxiliary switch 1122, auxiliary switch 1122 is opened before solenoid 1116 burns out.

Another failure mode that is addressed by GFCI 100 relates to the end-of-life failure mode of movistor (MOV) 1124. MOV 1124 is disposed in series with auxiliary switch 1122 and trip solenoid 1116. This arrangement significantly reduces the probability of damage due to an over-current situation. When MOV 1124 reaches end-of-life and shorts out, trip solenoid 1116 is energized and auxiliary switch 1122 is opened. As previously described, when auxiliary switch 1122 opens, the flow of short circuit current is terminated before any damage to GFCI 100 ensues.

GFCI 100 also includes trip indication circuit 1126. Trip indicator 1126 is implemented by placing LED1 and series resistors (R11-R14) in parallel with auxiliary switch 1122. LED1 is configured to emit a visual signal when circuit interrupter 1118 and auxiliary switch 1122 are in an open state (tripped).

GFCI 100 also includes a test circuit 1128. The test circuit 1128 is coupled between the line neutral terminal 1282 and the hot receptacle terminal. The test circuit includes a test button 130 disposed in series with test resistor R1.

Finally, GFCI 100 is equipped with a miswire circuit 1150. If an installer improperly connects the load terminals (1260, 1262) to a source of AC power, the miswire circuit 1150 generates a differential current that is detected in accordance with the procedures outlined above. The device 100 continues to trip out until the installer properly wires the device. When the device is properly wired, current flows unabated through miswire circuit 1150, whether GFCI 100 is tripped or not. Fuse S2 is designed to open-circuit after a predetermined period of time. Thus, miswire circuit 1150 is disabled once the GFCI 100 is correctly wired.

Reference is made to U.S. patent application Ser. No. 11/531,588, which is incorporated herein by reference as though fully set forth in its entirety, for a more detailed explanation of the GFCI circuit.

Figure 14:
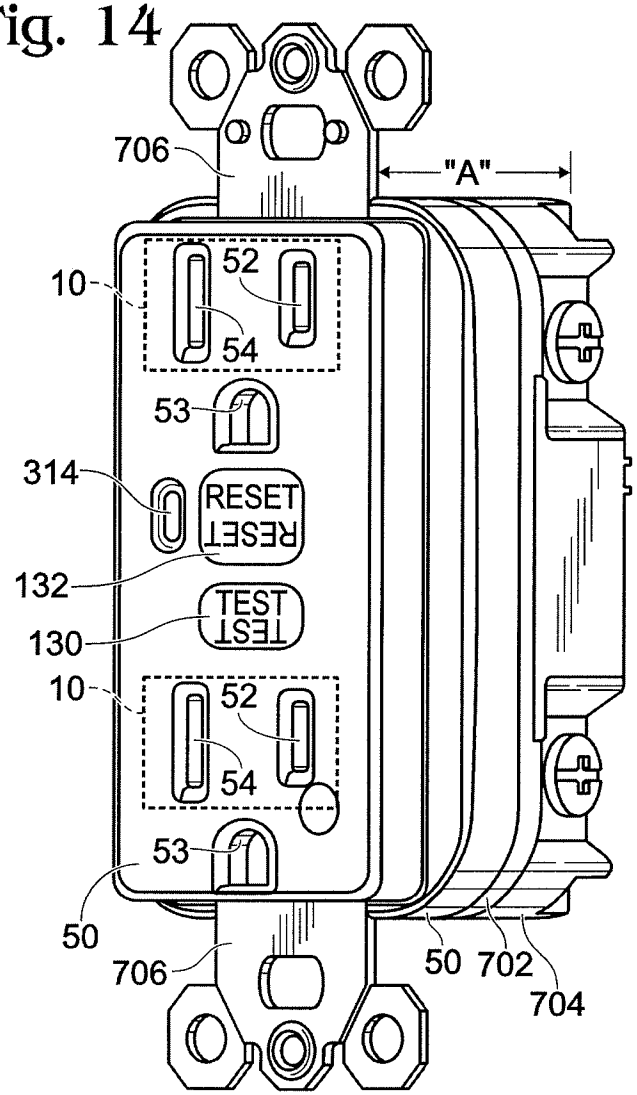
FIG. 14 is a perspective view of a GFCI receptacle in accordance with another embodiment of the present invention.

FIG. 14 is a perspective view of the GFCI 100 depicted in FIG. 13. The GFCI receptacle 100 includes a front cover 50. Cover 50 includes openings extending therethrough to receive the prongs of a standard form of male plug in conventional fashion. Each set of openings includes a hot receptacle opening 52, a neutral receptacle opening 54, and a ground receptacle opening 53. At least the hot receptacle opening 52 and the neutral receptacle opening 54 are protected by shutter assembly 10 (dashed lines) disposed within cover 50 in the manner previously described. GFCI 100 includes a body member 704. A component separator 702 is sandwiched between cover 50 body member 704. In an alternate embodiment, separator 702 may be entirely enclosed by cover 50 and body member 704. Line terminals and load terminals are electrically coupled, of course, to interior electrical components in accordance with the schematic shown in FIG. 13. As those of ordinary skill in the art will appreciate, the cover 50, separator 702, and body member 704 are formed from an electrically non-conductive material. Device 100 also includes mounting ears 706 that restrict the insertion depth of the device into the outlet box by a distance represented by dimension 'a.' Dimension 'a' is the distance between the back side of mounting ears 706 and the major rear surface of body member 704. The major rearward surface may be interrupted by protuberances associated with labels, terminals, relief pockets for internal components, and the like.

In one embodiment of the present invention, dimension 'a' is less than or equal to one (1.00) inch. The major rearward surface occupies at least 80% of the overall rear surface. In one embodiment, the mounting ears 706 are made from a non-conductive material. In an alternate embodiment, the mounting ears 706 are the exposed ends of an electrically conductive strap assembly connected to the grounding conductor of the electrical distribution system when the device 100 is installed. The conductive strap is connected to the receptacle ground terminals that accommodate the ground prong of the user attachable plug. The housing depicted in FIG. 14 may also be suitable for other GFCI embodiments as well as arc fault circuit interrupter (AFCI) embodiments.

Figure 15:
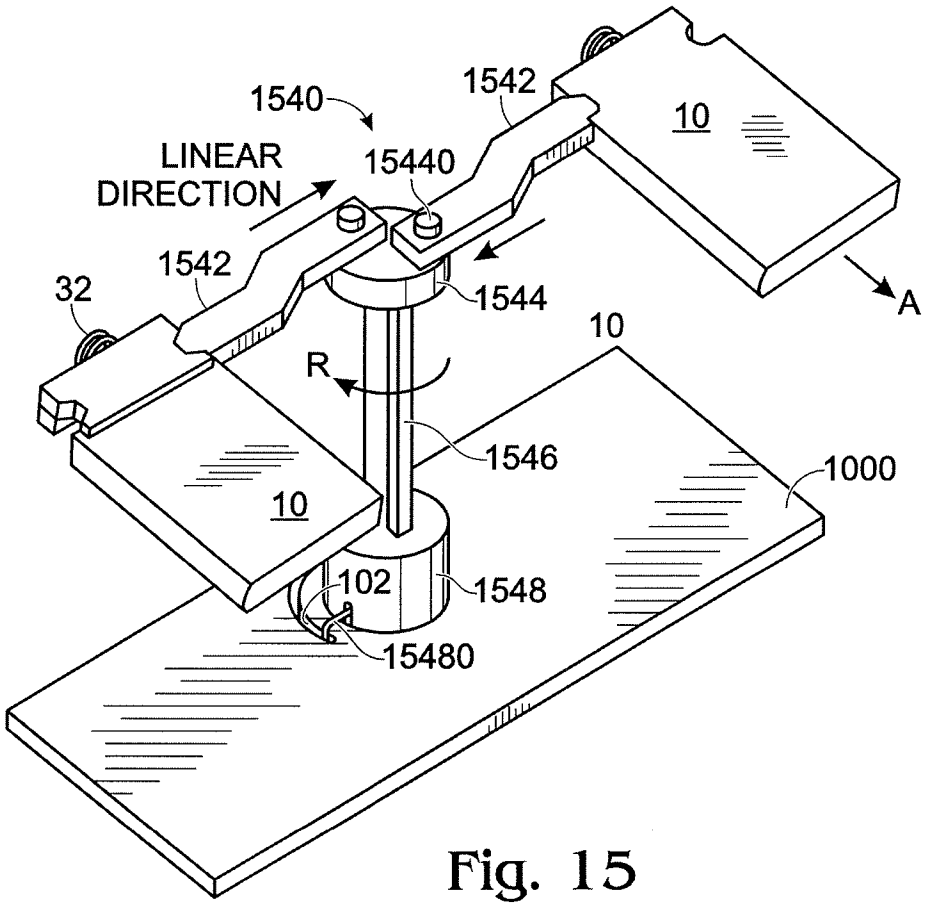
FIG. 15 is a detail view of a miswire lockout mechanism in accordance with the present invention.

FIG. 15 is a detail view of a miswire lockout mechanism that may be employed in conjunction with the GFCI 100 depicted in FIG. 13 and FIG. 14. A linkage assembly 1540 is disposed within the housing 704 (See FIG. 14). The linkage assembly 1540 mechanically couples the protective frameless shutter sub-assembly 10 to the miswire circuit 1150 (FIG. 13). Before device 100 is wired correctly, each protective shutter 10 is disposed in a locked position. The locked position, in effect, misaligns the shutter assembly 10, such that plug blades or other objects cannot make contact with the receptacle contacts. Miswire circuit 1150 is used to determine when device 100 has been properly wired. When the device has been properly wired, miswire circuit 1150 actuates linkage assembly 1540 causing the protective frameless shutter sub-assembly 10 to move from the locked position to the unlocked position. In the unlocked position, the shutter assembly is correctly aligned such that plug blades are permitted to make contact with the receptacle contacts upon insertion of the plug blades into the receptacle openings. However, as explained in detail above, frameless shutter sub-assembly 10 prevents objects that are inserted into individual receptacle openings from making contact with the receptacle contacts.

Linkage assembly 1540 includes two pivot arms 1542, each of which are removably coupled to a protective shutter 10 in the closed position. Cam member 1544 is coupled to pivot arms 1542, by way of pivots 15440. The cam member 1544 is configured to rotate around an axis of rotation to thereby move the pivot arms 1542 in the linear direction as shown. Rotor 1546 is coupled to cam 1544 at one end, and is also coupled to circuit board 1000 at an opposite end. A torsion spring assembly 1548 is coupled to rotor 1546. Spring assembly 1548 includes torsion spring 15480 which is coupled to the miswire circuit 1150 disposed on the other side of circuit board 1000.

In the locked position, torsion spring 15480 is in tension, and stores mechanical energy. When miswire circuit 1150 senses the proper wiring condition, it releases spring 15480, allowing it to move within slot 102. The stored mechanical energy is released, causing rotor 48 to rotate cam 46 about the axis of rotation. In response, each pivot arm 42 is moved in a linear direction as shown. In one embodiment of the present invention, torsion spring 15840 is held in place by a fuse element (S2) that is configured to open-circuit after current is applied for a predetermined period of time. The operation of the miswire circuit 1150 and fuse S2 was discussed above in detail.

Reference is made to U.S. Pat. No. 6,969,801 and U.S. patent application Ser. Nos. 10/729,685 and 10/900,788, which are incorporated herein by reference as though fully set forth in its entirety, for a more detailed explanation of the tamper resistant shutter mechanisms.

Figure 16:
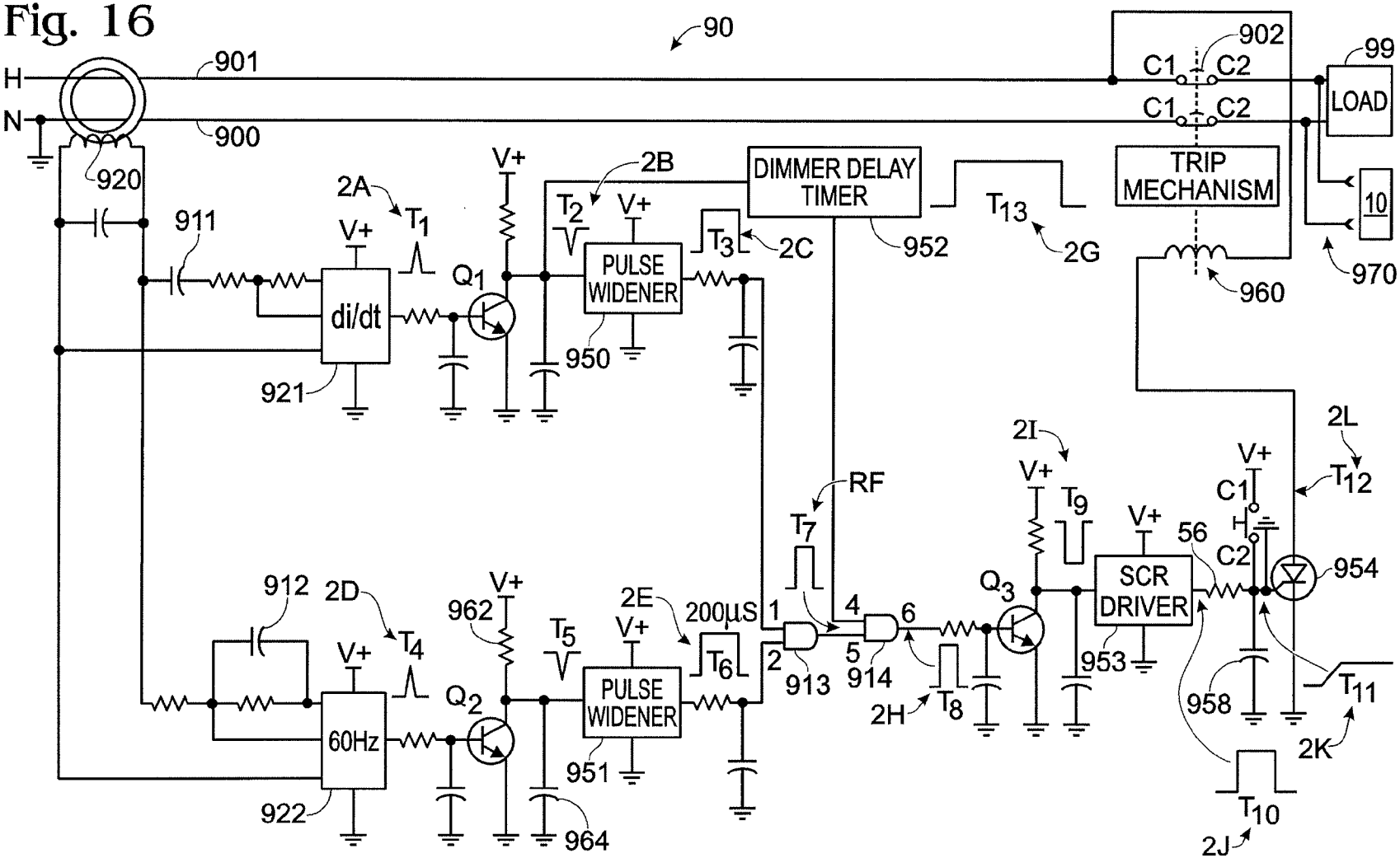
FIG. 16 is a schematic diagram of an arc fault circuit interrupter in accordance with an embodiment of the present invention.

FIG. 16 is a schematic diagram of an arc fault circuit interrupter in accordance with an embodiment of the present invention. As those of ordinary skill in the art will appreciate, the housing depicted in FIG. 14 is readily adapted to the AFCI embodiment described herein. Referring to FIG. 16, the load terminals are coupled to receptacle load terminals 970. The receptacle load terminals 970 are, in turn, protected by shutter assembly 10.

AFCI 90 is formed from components that are readily available and that can be easily integrated into an electrical receptacle, plug, or in-line device. The circuit is designed so that it can be manufactured in the same form as ground fault circuit interrupter (GFCI) receptacle devices. AFCI 90 protects an electrical circuit which includes at least a neutral conductor 900 and a line conductor 901 connected to a power source (not shown). A ground conductor (not shown) is optionally present. AFCI 90 detects electrical arcs occurring between line conductor 901 and ground, neutral conductor 900 and ground should the power source be of reverse polarity, or line conductor 901 and neutral conductor 900.

A circuit interrupter 902 is connected in series with line conductor 901 between the power source and a load 99. This embodiment incorporates a first stage arc sensor 920, shown as a current transformer, which is configured to respond to the rate of change of neutral and/or line conductor current with respect to time. Sensor 920 may be designed with a physically small core of a type and number of secondary turns which gives optimum sensitivity during arcing. Either a single conductor (LINE) or both conductors can pass thru the sensor. The arc fault detector detects arcs that are either LINE to GROUND or LINE to NEUTRAL. Sensor 920 feeds two detector/amplifiers 921, 922. Detector/amplifiers 921, 922 are preferably RV4141A (Fairchild Semiconductor) low power ground fault interrupter ICs. Detector/amplifier 921, also referred to as the di/dt stage, has a high pass filter capacitor 911 on its input side, while detector/amplifier 922, also referred to as the 60 Hz or "threshold" stage, uses a low pass filter capacitor 912 in a feedback stage. The 60 Hz threshold detector 922 controls the level at which an arcing condition is to be detected, e.g., at a 75 Ampere or greater load current.

Reference is made to U.S. patent application Ser. No. 11/531,588, which is incorporated herein by reference as though fully set forth in its entirety, for a more detailed explanation of the AFCI circuit.

Figure 17:
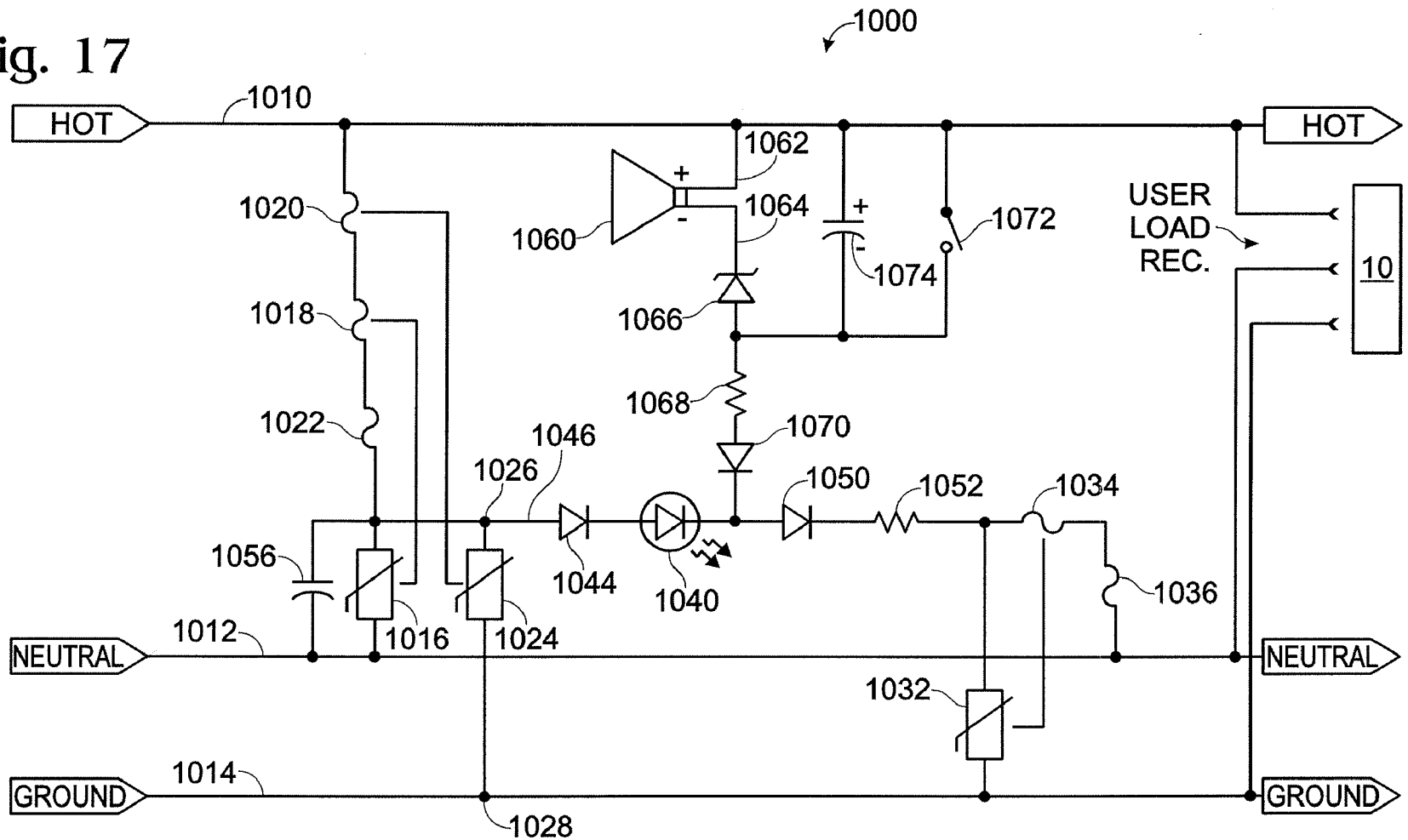
FIG. 17 is a schematic diagram of a TVSS electrical wiring device in accordance with an embodiment of the present invention.

FIG. 17 is a schematic diagram of a TVSS electrical wiring device in accordance with an embodiment of the present invention. A TVSS, also known as a surge protective device (SPD), protects wiring or a load from overvoltages that typically occur during lightning storms. TVSS 1000 is configured to protect a low voltage 120 VAC single phase electrical circuit. The circuit includes three conductors that, for convenience, are referred to herein as the hot 1010, neutral 1012, and ground 1014 conductors. The three conductors are disposed between line terminals disposed on the left side of the schematic and load terminals disposed on the right side of the schematic. The load terminals, in turn, are coupled to user accessible load receptacles. In accordance with the teachings of the present invention, the user accessible receptacles are protected by shutter assembly 10.

Transient voltages are known to occur between any pair of two of these conductors, and surge suppression devices, such as metal oxide varistors, are arranged to absorb transient voltage surges between any pair of the conductors. Fuses are provided for disconnecting the surge suppression devices from the circuit in the event of failure. Two specific failure modes are provided for, over current failure and temperature failure.

A first metal oxide varistor 1016, such as a 150 volt RMS metal oxide varistor is connected in series with a first thermally responsive fuse 18, a second thermally responsive fuse 1020, and a conventional over current fuse 1022, and the series combination is connected between the hot conductor 1010 and the neutral conductor 1012. A second varistor 1024 of the same type is connected at one end 1026 in series with three fuses just mentioned, and the other end 1028 is connected to the ground conductor. These two varistors protect the hot-neutral and hot-ground pairs. Each of the thermally responsive fuses 1018, 1020 is positioned physically close to one of the varistors 1016, 1024, so that a rise in temperature of the varistor, as would be caused by a failure, causes the adjacent fuse to open. Since the two thermally responsive fuses 1018, 1020 are connected in series, the thermal failure of either of the varistors will cause the connection of both varistors to the hot conductor to be broken.

A third metal oxide varistor 1032 is connected in series with another thermal fuse 1034, and an over current fuse 1036. The combination of the third varistor 1032 and the two fuses 1034, 1036 is connected between the neutral conductor 1012 and the ground conductor 1014. A thermal failure or an impedance failure of the third varistor device 1032 will cause one of the thermal fuse 1034 or the over current fuse 1036 to open, thereby disconnecting the varistor from the neutral-ground circuit.

A visible indicator, such as a light emitting diode 1040, is connected between the hot conductor 1010 and the neutral conductor, 1012 so that the light emitting diode 1040 is illuminated when all three of the varistors 1016, 1024, 1032 are functional, more particularly when none of the fuses 1018, 1020, 1022, 1034, 1036 is blown. A half wave rectifier diode 1044 has its cathode 1046 connected to the electrical conductor in series with the two thermal fuses 1018, 1020 and the over current fuse 1022, feeding the first two varistors 1016, 1024. The cathode of the rectifier diode 1044 is connected to one terminal of the light emitting diode 1040. The other terminal of the light emitting diode 1040 is connected through a blocking diode 1050 to a current limiting resistor 52, arranged in series, and then through the third thermal fuse 1034 and third over current fuse 1036 to the neutral electrical conductor 1012. A decoupling capacitor 1056 is preferably connected between the anode of the diode 1044 and the neutral conductor 1012.

When all of the fuses 1018, 1020, 1022, 1034 and 1036 are intact, that is when no fault has occurred, a circuit is created from the hot-conductor 1010 through the rectifier diode 1044, the light emitting diode 1040, the blocking diode 1050, the current limiting resistor 1052 and thence to the neutral conductor. The light emitting diode provides visible indication. If any of the three thermal fuses 1018, 1020, 1034 or two over current fuses opens 1022, 1036, the circuit is interrupted and the light emitting diode is extinguished, alerting a fault condition.

A TVSS 1000 in accordance with this invention also provides an audible indication of a fault in either of the varistors 1016, 1024 protecting the hot-neutral circuit or the hot-ground circuit respectively. A device, such as a simple buzzer 1060 or a piezoelectric device, has one terminal 1062 connected to the hot conductor 1010, and the other terminal 1064 connected by way of the series combination of a zener diode 1066, a current limiting resistor 1068, a first blocking diode 1070, second blocking diode 1050, second current limiting resistor 1052, thermal fuse 1034, and the over current fuse 1036 to the neutral conductor 1012. The first and second thermal fuses 1018, 1020 and the first over current fuse 1022 are connected in series with rectifier diode 1044 and the light emitting diode 1040 between the hot electrical conductor 1010 and the junction of the two blocking diodes 1070, 1050 just mentioned, so that in normal operation no significant voltage passes through the buzzer, and the buzzer remains silent. If either of the varistors 1016, 1024 bridging the hot-neutral or hot-ground fails and any of the first and second thermal fuses 1018, 1020 and the first over current fuse 1022 is opened, voltage across the buzzer 1060 will cause it to sound.

In order to allow a user to deactivate the buzzer while awaiting repair, a normally open switch 1072 is connected effectively across the combination of the buzzer 1060 and the zener diode 1066. When the switch 1072 is closed, current through the buzzer 1060 is shunted through the switch and the buzzer is silenced. A capacitor 1074 is provided across the zener/audio alarm network to provide a DC voltage component to improve the audio alarm operating performance.

The buzzer deactivating switch 1072 is a simple normally open electrical switch, rather than a device that permanently deactivates the alarm 1060 or permanently interrupts a circuit trace. The switch 1072, once closed, can be opened at will and the buzzer 1060 reactivated. Accidentally deactivating the buzzer might destroy the audible alarm feature of the device permanently, and require its replacement even before it is installed. The use of a normally open switch in accordance with this invention eliminates this problem, and allows the alarm to be deactivated and reactivated.

Reference is made to U.S. patent application Ser. No. 11/531,588, which is incorporated herein by reference as though fully set forth in its entirety, for a more detailed explanation of TVSS wiring device.

Figure 18:
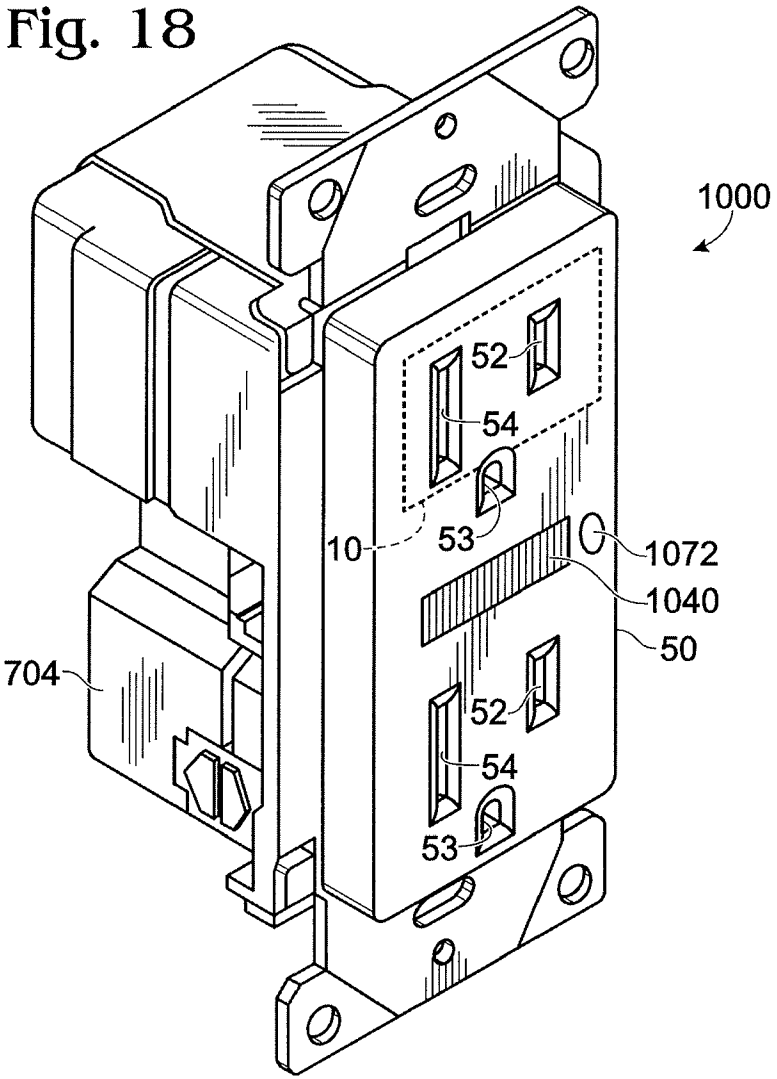
FIG. 18 is a perspective view of a TVSS receptacle in accordance with an embodiment of the present invention.

FIG. 18 is a perspective view of a TVSS receptacle in accordance with an embodiment of the present invention. TVSS receptacle 1000 includes a cover 50 and rear housing 704, respectively, having cooperatively formed edge portions for mating engagement to provide an enclosed housing for the various components, as explained later. Cover 50 includes front wall 51 having two sets of openings extending therethrough to receive the prongs of a standard form of male plug in conventional fashion. Each set of openings includes a hot receptacle opening 52, a neutral receptacle opening 54, and a ground receptacle opening 53. At least the hot receptacle opening 52 and the neutral receptacle opening 54 are protected by shutter assembly 10 (dashed lines) disposed within cover 50 in the manner previously described. Also mounted in an opening in front wall 51, between the two sets of openings, is a lens for transmitting light emitted from LED 1040. Switch 1072 is disposed in another opening in front wall 51.

Figure 19:
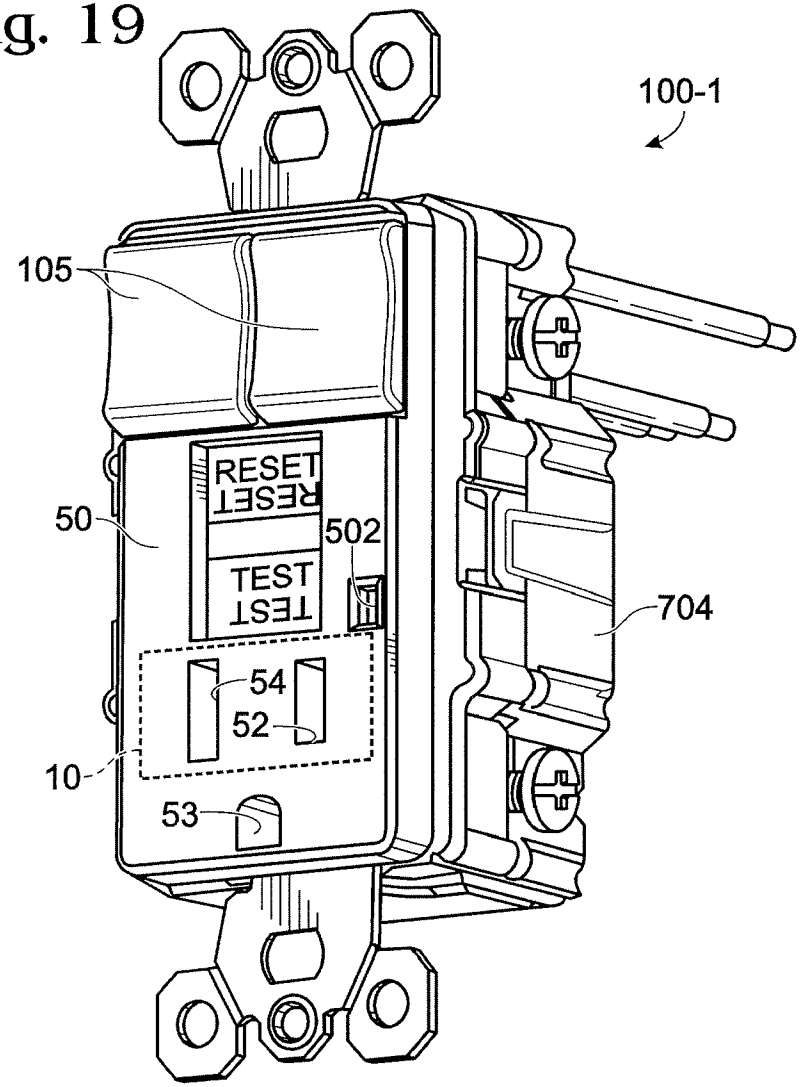
FIG. 19 is a perspective view of a GFCI receptacle and switch combination device in accordance with yet another embodiment of the present invention.

Referring to FIG. 19, a perspective view of a GFCI receptacle and switch combination device 100-1 in accordance with yet another embodiment of the present invention is disclosed. The GFCI receptacle includes hot receptacle opening 52 neutral receptacle opening 54, and ground receptacle opening 53. At least the hot receptacle opening 52 and the neutral receptacle opening 54 are protected by shutter assembly 10 (dashed lines) disposed within cover 50 in the manner previously described.

In one embodiment, the GFCI receptacle is independent of the single pole switch 105. The load terminals of the GFCI receptacle may be electrically connected to the line terminals of the single pole switch 105. Thus, switch 105 is protected by the circuit protection components of GFCI 100-1. When GFCI 100-1 sense a fault condition, the GFCI trips in the manner described above, and no power is supplied to the switch 105. The electrical wiring device may further include a trip indicator 1314 mounted in and visible through the cover 50. The trip indicator 1314 may be implemented using an LED, a neon source, or other suitable light source.

Reference is made to U.S. patent application Ser. No. 10/994,662, which is incorporated herein by reference as though fully set forth in its entirety, for a more detailed explanation of a GFCI/Switch combination device.

Figure 20:
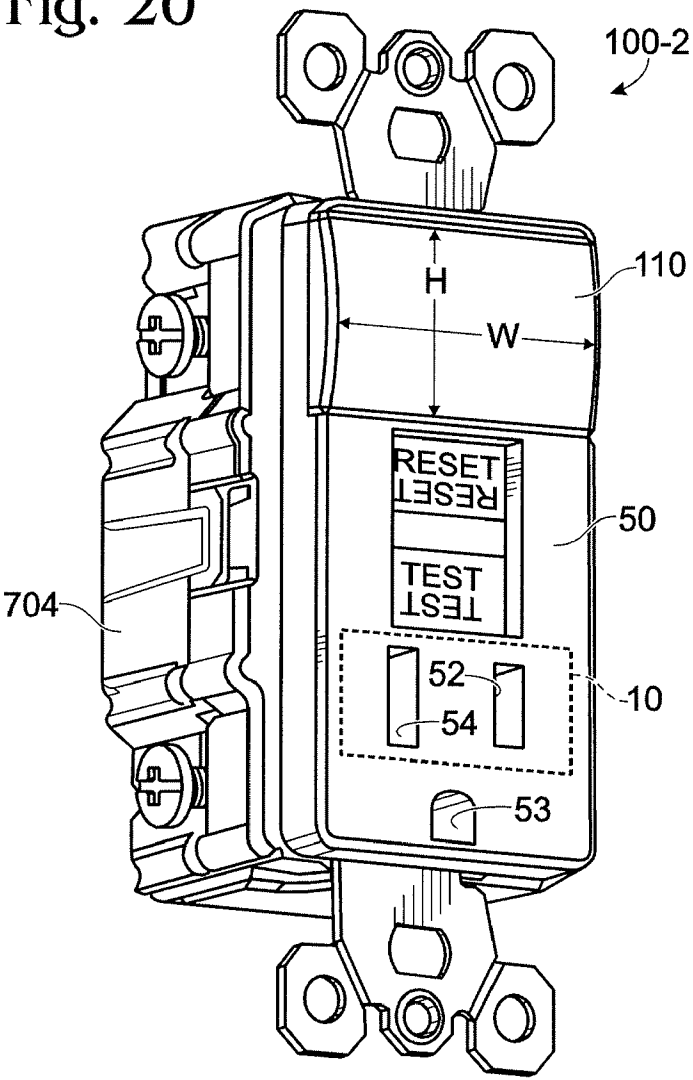
FIG. 20 is a perspective view of a GFCI receptacle and night light combination device in accordance with yet another embodiment of the present invention.

Referring to FIG. 20, a perspective view of a GFCI receptacle and night light combination device 100-2 in accordance with yet another embodiment of the present invention is disclosed. The electrical wiring device 100-2 is disposed within a housing 704 and front cover 50. The GFCI employed herein is similar to the GFCI disclosed in FIG. 13 and includes a single set of user accessible load receptacles. The receptacles include a hot receptacle opening 52 and a neutral receptacle opening 54, both of which are protected by shutter assembly 10, as indicated by the dashed lines.

The night light portion includes a lens cover 110. As those of ordinary skill in the art will appreciate, lens cover 110 may be fabricated using a clear or translucent material in accordance with factors such as light source type, emitted wavelength, desired light intensity, desired light diffusion characteristics, etc.

In one embodiment of the present invention, lens cover 110 may be removable to provide access to the light source. Lens cover 110 has a height (H) less than or equal to approximately 0.8 inch and a width (W) that substantially equal to the width of cover assembly 50.

Reference is made to U.S. patent application Ser. No. 10/998,369, which is incorporated herein by reference as though fully set forth in its entirety, for a more detailed explanation of a GFCI/Night Light combination device.

Figure 21:
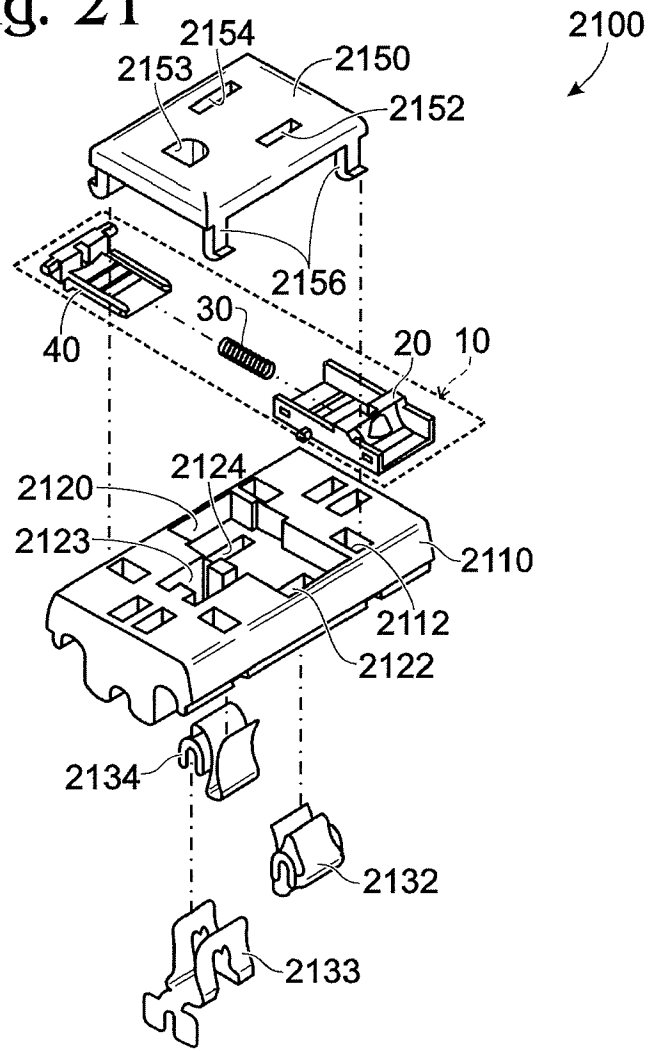
FIG. 21 is an exploded perspective view of a raceway structure in accordance with an embodiment of the present invention.

As embodied herein and depicted in FIG. 21, an exploded perspective view of a raceway structure 2100 in accordance with an embodiment of the present invention is disclosed. Raceway structures 2100 are configured for installation in an array of apertures disposed in a raceway housing (not shown). The raceway structures 2100 are oriented in the raceway housing by way of the apertures. Depending on the apertures, the longitudinal axes of structures 2100 are parallel to the width axis of the raceway housing, or they may be normal to the width axis. The raceway housing is made out of plastic or metal.

Raceway structure 2100 includes a cover member 2150 that is configured to mate with a body member 2110. Cover member 2150 includes snap-in members 2156 that are configured to mate with openings 2112 disposed in body member 2110. Cover member 2150 also includes receptacle openings 2152, 2153, and 2154, to accommodate the hot plug blade, ground plug blade and neutral plug blade, respectively, of a plug device.

The raceway body member 2110 includes a shutter registration pocket 2120. The shutter registration pocket 2120 includes a hot contact opening 2122 that is aligned with hot cover receptacle opening 2152. The hot contact opening is configured to receive hot contact 2132 therein. Pocket 2120 also includes a neutral contact opening 2124, the opening 2124 being aligned with neutral cover receptacle opening 2154. The neutral contact opening 2124 is configured to receive neutral contact 2134 therein. Pocket 2120 further includes a ground contact opening 2123 aligned with ground cover receptacle opening 2153. The ground contact opening 2123 is configured to receive ground contact 2133 therein.

As its name suggests, the shutter registration pocket 2120 is configured to accommodate protective shutter assembly 10 (shown in an exploded view in FIG. 21). Accordingly, shutter assembly 10 is disposed between the cover member 2150 and contacts (2132, 2133, 2134) and prevents an object inserted in receptacle opening 2152 from engaging contact 2132 or an object inserted in receptacle opening 2154 from engaging contact 2134 unless those objects happen to be the hot plug blade and the neutral plug blade of a plug device.

Figure 22:
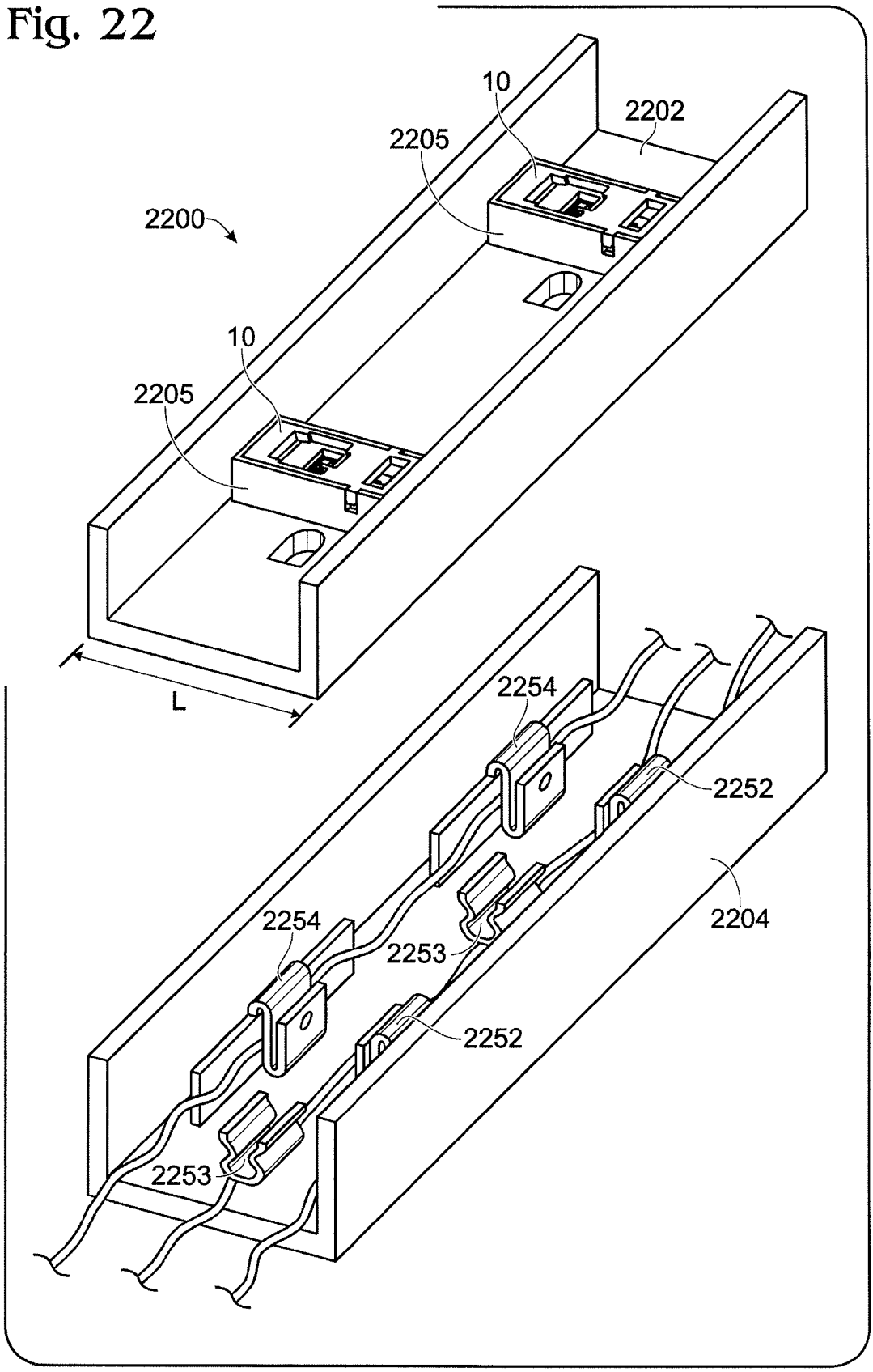
FIG. 22 is an exploded perspective view of a raceway structure in accordance with another embodiment of the present invention.

As embodied herein and depicted in FIG. 22, an exploded perspective view of a raceway structure 2200 in accordance with another embodiment of the present invention is disclosed. The raceway structure includes an elongated top portion 2202 and an elongated base portion 2204. The top portion 2202 includes registration members 2205 that are configured to register and align shutter assembly 10 in the correct position within top portion 2202.

The bottom portion 2204 also includes registration members (not shown for clarity of illustration) spaced at appropriate positions along the longitudinal axis of the bottom portion 2204. The bottom registration members are configured to receive hot contact 2252, neutral contact 2254, and ground contact 2253 at each position along the longitudinal axis of the bottom portion 2204. Of course, those of ordinary skill in the art will understand that these positions are aligned with the locations of the receptacle openings formed in top portion 2202.

The raceway structure 2200, therefore, is assembled by coupling the top portion 2202 to the bottom portion 2204 such that a shutter assembly 10 is disposed between each set of receptacle openings disposed in the upper portion 2202 and a corresponding set of contacts disposed in the lower portion 2204.

Raceway structure 2200 commonly has an interior width dimension denoted in FIG. 22 as dimension "L." Since dimension L is typically about 1.00 inch, the length dimension of the frameless shutter assembly 10 (previously noted as about 0.86 inches) is readily accommodated. Referring back to the embodiment shown in FIG. 21, the length axis of the frameless shutter assembly plus an allowance for the thickness of the walls surrounding pocket 2120 are likewise accommodated within dimension L.

A multiple outlet strip (MOS) is similar to raceway except that it is typically shorter in length. It may be provided with an electrical plug and its receptacle outlets may be more tightly clustered in a row or even disposed in more than one row. Despite these differences, the receptacle outlets in an MOS can be configured to include the shutter mechanism assembly such as in the manners described for raceway.

Figure 23:
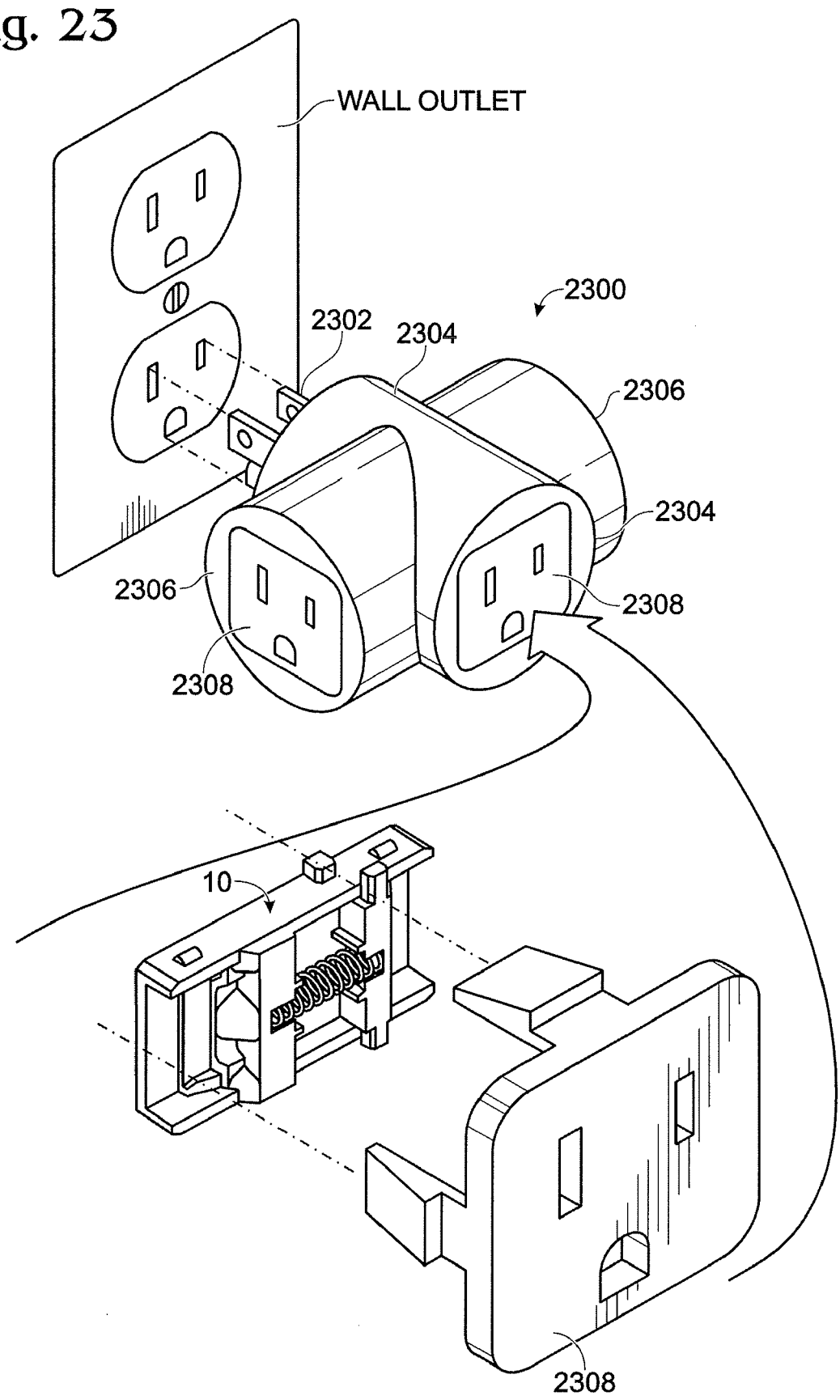
FIG. 23 is a perspective detail view of a power adapter receptacle in accordance with another embodiment of the present invention.

Referring to FIG. 23, a perspective detail view of a power adapter receptacle in accordance with another embodiment of the present invention. In this embodiment, adapter 2300 includes a set of male contact blades 2302 that are configured to be inserted into a standard wall socket. The male contact blades are electrically coupled to three sets of female contacts, i.e., one set of female contacts (not shown) disposed in each of the main barrel 2304 and side barrels 2306. The female contact sets are accessible to the user via a cover plate 2308 in the manner shown. The shutter assembly 10 of the present invention is disposed between cover 2308 and the set of female contacts.

Figure 24:
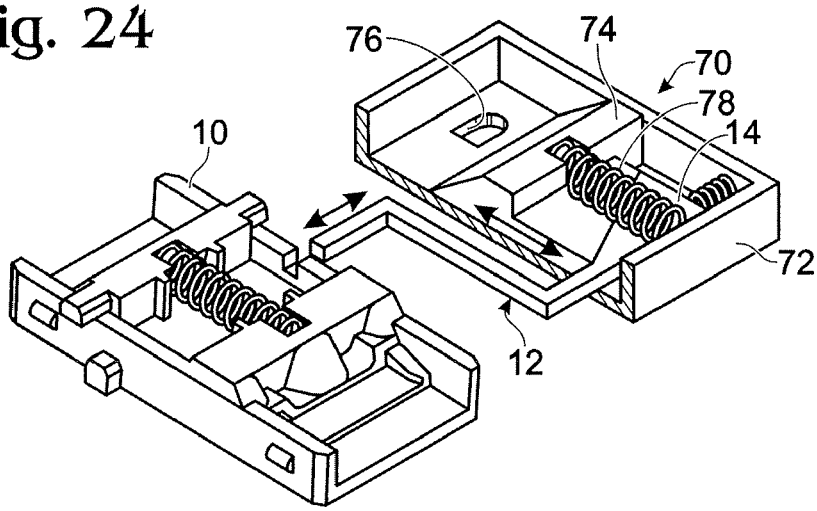
FIG. 24 is a perspective view of a ground blade shutter assembly in accordance with the present invention.

As embodied herein and depicted in FIG. 24, a perspective view of a ground blade shutter assembly 70 in accordance with the present invention is disclosed. In this embodiment, ground shutter 70 is coupled to protective shutter 10 by a lockout am 12. Ground shutter 70 includes a base member 72 configured to accommodate slide shutter 74 and shutter spring member 78. Base member 72 has a shutter blade opening 76 formed therein. Lockout arm 12 includes a drive cam 14. Slide shutter 74 drives cam 14 from a locked to an unlocked position. A return spring 79 (not shown in this view for clarity of illustration) is disposed between drive cam 14 and a sidewall of base member 72.

Ground shutter assembly 70 is configured to snap into a registration pocket (not shown for clarity of illustration) disposed inside the front cover 50 of the receptacle. The registration pocket aligns the ground shutter blade opening 76 with the ground receptacle opening 53 (See FIG. 5 and FIG. 6) in cover 50. In FIG. 24, ground shutter 70 is open.

The ground blade shutter affords several benefits. When a ground blade is not present, shutter 70 is in the closed position such the slide shutter 74 blocks ground shutter blade opening 76. One benefit is that ground shutter 70 prevents contaminants, insects and other such undesirable materials from entering the wiring device. Another benefit is that when a ground blade is not present, the hot and neutral shutters in shutter assembly 10 are locked in the closed position by lockout arm 12. Lockout is maintained even if there is an attempt to insert an electrical plug having hot and neutral blades. This prevents an ungrounded plug (or a plug with a missing ground blade) from receiving electrical power.

Figure 25A:
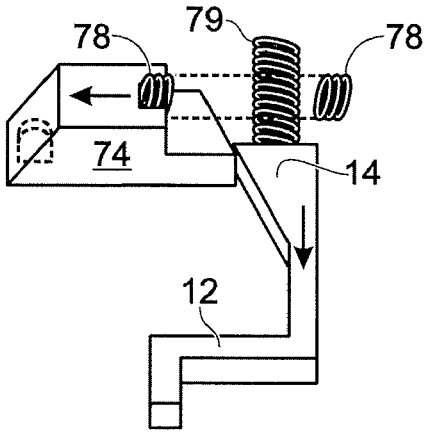
FIGS. 25A-D are detail views of the ground blade shutter assembly depicted in FIG. 24.

Referring to FIGS. 25A-D, detailed operational views of the ground blade shutter assembly depicted in FIG. 24 are shown. The ground shutter assembly 70 operates as follows. Referring to FIG. 25A, slide shutter 74 is biased to the left (closed) by the ground shutter spring 78 until a ground prong of a plug is inserted. In the view of FIG. 25A, those of ordinary skill in the art will understand that a portion of spring 78 is cut-away for clarity of illustration.

Figure 25B:
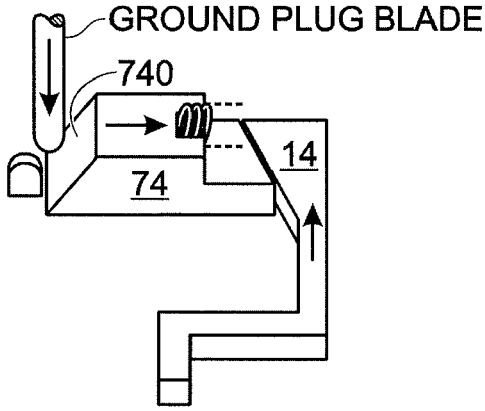

As shown in FIG. 25B, as the ground prong pushes downward against the ramped surface 740, the slide shutter 74 is moved towards the right, compressing spring 78 (not shown in this view). The ground prong continues to move downward until it passes through ground shutter blade opening 76 to make electrical contact with a ground contact disposed underneath ground shutter assembly 70.

Figure 25C:
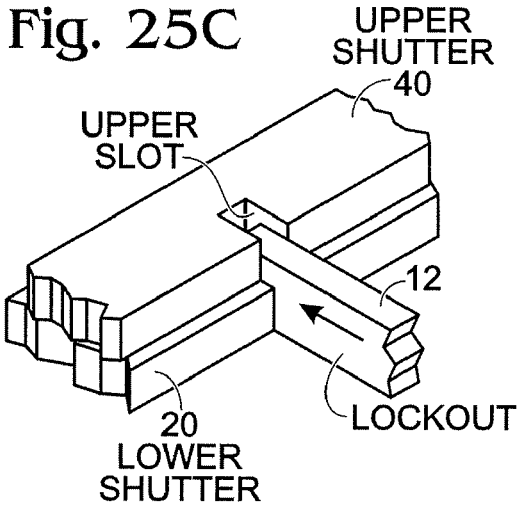

Referring to FIG. 25C, lockout arm 12 decouples the ground shutter assembly 70 from the protective shutter assembly 10. In this embodiment, the frameless shutter assembly 10 includes slots in the upper and lower rails (22, 42) which accommodate lockout arm 12. Note that lower shutter 20 and upper shutter 40 cannot move relative to each other when lockout arm 12 is disposed in the upper and lower slots. Thus, the protective shutter 10 is "locked out" and cannot move from the closed position to the open position in response to the insertion of an electrical plug unless the electrical plug includes a ground plug, i.e., a ground prong is inserted first.

Referring back to FIGS. 25 A-C, slide shutter 74 has a diagonal edge that is configured to engage the diagonal edge of the drive cam 14. When the slide shutter 74 is moved to the right by the ground prong, slide shutter 74 bears against drive cam 14 which compresses the return spring 79. The force applied by the slide shutter removes the lockout arm 12 from the upper and lower slot.

Figure 25D:
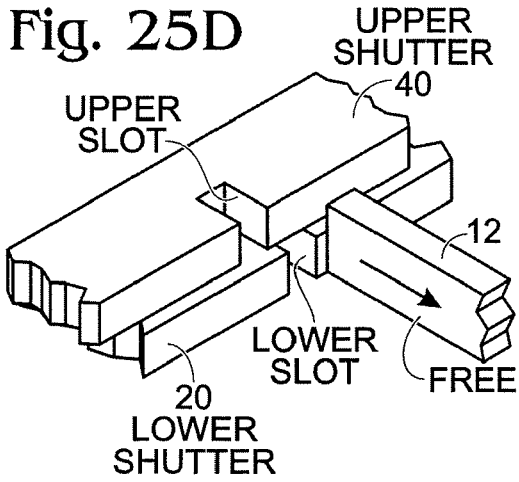

Referring to FIG. 25D, the lower shutter 20 and the upper shutter 40 are freed and are able to move from the closed position to the open position in response to the insertion of the hot and neutral blades of the plug. When the plug is removed, all of the shutters (hot, neutral, and ground) return to their closed positions. Lockout arm is also re-inserted into the upper and lower slots. The process repeats itself when a plug is re-inserted into the wiring device.

A ground blade shutter may be particularly useful in duplex receptacles having an isolated ground configuration. The aforementioned isolated ground configuration refers to a receptacle device having mounting straps that are electrically isolated from the ground contacts.

Figure 26:
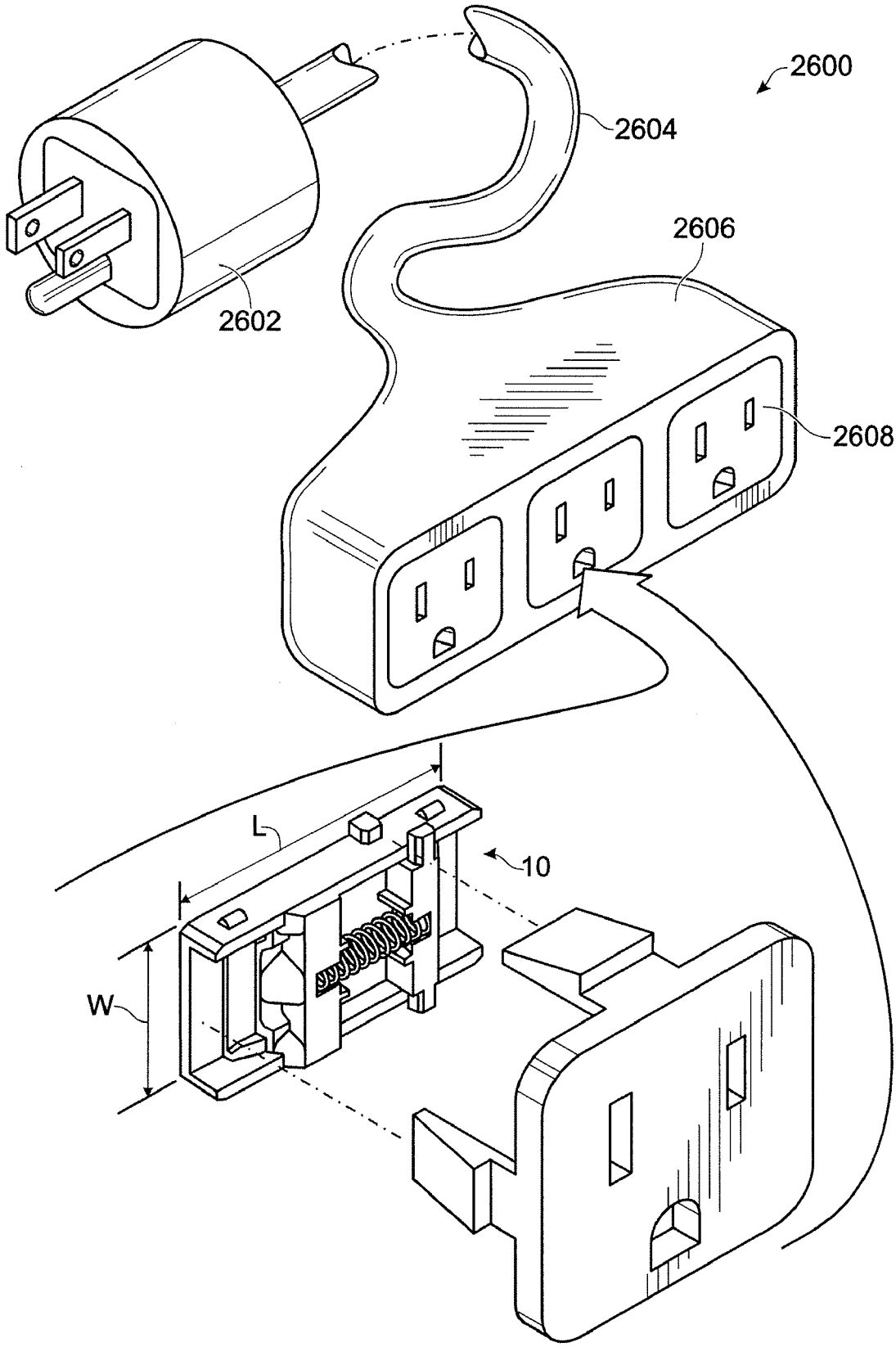
FIG. 26 is a perspective detail view of an extension cord device in accordance with another embodiment of the present invention.

Referring to FIG. 26, a perspective detail view of an extension cord device in accordance with another embodiment of the present invention is disclosed. In this embodiment, adapter 2600 includes a male plug connector 2602 that is configured to be inserted into a standard wall socket. The male contact blades are electrically coupled to three or more sets of female contacts disposed in head connector portion 2606 by way of wire 2604. The female contact sets are accessible to the user via a cover plate 2608 in the manner shown. The shutter assembly 10 of the present invention is disposed between cover plate 2608 and the set of female contacts disposed in head 2606. Those of ordinary skill in the art will appreciate that the compact nature of shutter assembly enables the head connector to include three or more user accessible outlets. As noted previously, in a 15A rated receptacle, the length (L) is approximately 0.860 inches or less, the width (W) is approximately 0.460 inches or less, and the thickness of the shutter assembly is approximately 0.170 inches or less. Accordingly, the width of the connector head 2606 (for three outlets) may be substantially less than one-half (0.5) inch.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalents.

What is claimed is:

1. A protective shutter assembly for use within a cover assembly of an electrical wiring device, the assembly comprising:

a frameless shutter sub-assembly including a first shutter member and a second shutter member movable between a closed position and an open position, the frameless shutter sub-assembly being configured to move from the closed position to the open position in response to engaging at least one plug blade having a predetermined plug blade geometry;

a spring member coupled to the first shutter member and the second shutter member within the frameless shutter sub-assembly, the spring member being configured to bias the frameless shutter sub-assembly in the closed position;

at least one retainer element disposed in the frameless shutter sub-assembly, the at least one retainer element being configured to retain the spring member within the frameless shutter sub-assembly; and at least one registration member disposed on the frameless shutter sub-assembly, the at least one registration member being configured to position and align the protective shutter assembly within the cover assembly.

2. The assembly of claim 1, further comprising a ground shutter sub-assembly coupled to the protective shutter assembly and configured to prevent the protective shutter assembly from moving from the closed position to the open position unless the ground shutter sub-assembly is engaged by the plug ground contact blade.

3. The assembly of claim 1, the spring member being configured to oppose movement of the frameless shutter sub-assembly from the closed position to the open position.

4. The assembly of claim 1, wherein the first shutter member and the second shutter member are movable relative to each other to effect the open position only if both the first shutter member and the second shutter member are simultaneously engaged by a hot plug blade and a neutral plug blade.

5. The assembly of claim 4, wherein the first shutter member includes a first hot contact aperture and a neutral contact aperture, and the second shutter member includes a second hot contact aperture.

6. The assembly of claim 5, wherein the first shutter member and the second shutter member are movable relative to each other from the closed position to the open position in response to being simultaneously engaged by the hot plug blade and the neutral plug blade such that the first hot contact aperture is aligned with the second hot contact aperture and the neutral contact aperture is unblocked by the second shutter member.

7. The assembly of claim 4, wherein the first shutter member includes a hot blade contact structure and the second shutter member includes a neutral blade contact structure with the spring member being disposed therebetween.

8. The assembly of claim 7, wherein the spring member is in compression in the open state.

9. The assembly of claim 7, wherein the at least one retainer element includes a first retainer element disposed in the first shutter member and a second retainer element disposed in the second shutter member.

10. The assembly of claim 4, wherein the first shutter member and the second shutter member each include a plug blade detection structure disposed thereon, the plug blade detection structure being configured to engage the plug blade having predetermined characteristics and not engage objects not having the predetermined characteristics.

11. The assembly of claim 10, wherein the blade detection structure only permits the frameless shutter sub-assembly to open if the width of an inserted object is greater than a predetermined amount.

12. The assembly of claim 4, wherein the first shutter member and the second shutter member each include a ramp having a contoured surface, whereby an object having less than the predetermined width slides off of the ramp, preventing the object from moving the frameless shutter sub-assembly to the open position.

13. The assembly of claim 12, wherein the contoured surface is one of an arcuate, pointed, or ramped surface.

14. The assembly of claim 4, wherein the at least one registration member includes at least one first registration member coupled to the first shutter member and a second registration member coupled to the second shutter member, the at least one first registration member and the second registration member being configured to align the protective shutter assembly with the cover assembly at a position along a longitudinal axis of the protective shutter assembly.

15. The assembly of claim 14, wherein the at least one first registration member includes a longitudinal axis registration member and a third registration member configured to align the protective shutter assembly with the cover assembly in an axis normal to the longitudinal axis.

16. The assembly of claim 15, wherein the third registration member is a snap-in structure configured to couple the protective shutter assembly to the cover assembly.

17. The assembly of claim 4, wherein the first and second shutter members move in opposite directions as the protective shutter assembly moves from the closed position to the open position.

18. The assembly of claim 1, wherein the protective shutter assembly is characterized by a length approximately equal to an inch.

19. The assembly of claim 18, wherein the length is less than 0.9 inches if the plug blades are in a 15 Amperes configuration and less than 1.10 inches if the plug blades are in a 20 Amperes configuration.

20. The assembly of claim 1, wherein the protective shutter assembly is characterized by a width less than or equal to 0.5 inches or a thickness less than or equal 0.2 inches.

21. The assembly of claim 1, wherein the frameless shutter sub-assembly further comprises:

the first shutter member including an elongated slot disposed along a transverse axis of the shutter assembly;

the second shutter member coupled to the first shutter member, the first shutter member and the second shutter member being movable relative to each other to effect the open position only if both the first shutter member and the second shutter member are simultaneously engaged by a hot plug blade and a neutral plug blade; and a third shutter member disposed in the slot, the third shutter member being operable in conjunction with the second member to block a T-slot receptacle opening in the cover assembly in the closed position.

22. The assembly of claim 21, wherein the second shutter includes a cam member configured to engage the third shutter member, the cam member being configured to urge the third shutter member in a first direction along the transverse axis to cover a portion of the T-slot in the closed position.

23. The assembly of claim 22, wherein the third shutter member includes a ramp portion configured to engage a portion of the neutral plug blade, the neutral plug blade being configured to move the third shutter member in a second direction along the transverse axis as the first shutter member and the second shutter member move relative to each other to effect the open position.

24. The assembly of claim 23, wherein the first shutter member includes a first hot contact aperture and a neutral contact aperture, and the second shutter member includes a second hot contact aperture.

25. The assembly of claim 24, wherein the first shutter member and the second shutter member are movable relative to each other from the closed position to the open position in response to being simultaneously engaged by the hot plug blade and the neutral plug blade such that the first hot contact aperture is aligned with the second hot contact aperture and the neutral contact aperture is unblocked by the second shutter.

26. The assembly of claim 21, wherein the third shutter member is configured to snap into the slot.

27. The assembly of claim 21, wherein the spring member is the only spring element in the protective shutter assembly.

28. The assembly of claim 1, wherein the at least one plug blade includes a set of plug blades, the set of plug blades including at least a hot plug blade and a neutral plug blade.

29. The assembly of claim 1, wherein the spring member is the only spring element in the protective shutter assembly.

30. An electrical wiring device assembly comprising:

a cover assembly including at least one set of receptacle openings configured to accommodate a set of plug blades having a predetermined plug blade geometry, the cover assembly also including at least one cover registration structure;

a plurality of receptacle contacts disposed in the device, each of the plurality of receptacle contacts being in communication with a corresponding one of the at least one set of receptacle openings; and a frameless protective shutter assembly disposed in the cover assembly, the frameless protective shutter assembly including a first shutter member and a second shutter member configured to move from a closed position to an open position in response to engaging at least one of the set of plug blades, the plurality of receptacle contacts being accessible to the set of plug blades in the open position, the frameless protective shutter assembly including a spring member coupled to the first shutter member and the second shutter member and at least one retainer element configured to retain the spring member within the frameless protective shutter assembly, the frameless protective shutter assembly also including at least one shutter assembly registration member configured to mate with the at least one cover registration structure.

31. The assembly of claim 30, wherein the first shutter member and the second shutter member are movable relative to each other to effect the open position only if both the first shutter member and the second shutter member are simultaneously engaged by a hot plug blade and a neutral plug blade.

32. The assembly of claim 31, wherein the first shutter member includes a first hot contact aperture and a neutral contact aperture, and the second shutter member including a second hot contact aperture.

33. The assembly of claim 32, wherein the first shutter member and the second shutter member are movable relative to each other from the closed position to the open position in response to being simultaneously engaged by the hot plug blade and the neutral plug blade such that the first hot contact aperture is aligned with the second hot contact aperture and the neutral contact aperture is unblocked by the second shutter.

34. The assembly of claim 31, wherein the spring member is disposed between the first shutter member and the second shutter member.

35. The assembly of claim 34, wherein the at least one retainer element includes a first retainer element disposed in the first shutter member and a second retainer element disposed in the second shutter member, the first retainer element receiving a first end of the spring element and the second retainer element receiving a second end of the spring element.

36. The assembly of claim 31, wherein the first and second shutters move in opposite directions as the protective shutter assembly moves from the closed position to the open position.

37. The assembly of claim 31, the first shutter member and the second shutter member each include a ramp having a contoured surface, whereby an object having less than the predetermined width slides off of the ramp, preventing the object from moving the frameless shutter sub-assembly to the open position.

38. The assembly of claim 37, wherein the contoured surface is one of an arcuate, pointed, or ramped surface.

39. The assembly of claim 31, wherein the at least one registration member includes a pair of first registration members coupled to the first shutter member and a pair of second registration members coupled to the second shutter member, the at least one cover registration structure including spaced apart registration structures configured to accommodate the pair of first registration members and the pair of second registration members such that the frameless protective shutter assembly is correctly aligned and positioned within the cover assembly.

40. The assembly of claim 39, wherein each of the spaced apart registration structures includes an alignment key configured to accommodate one of the first registration members and one of the second registration members.

41. The assembly of claim 39, wherein the at least one registration member includes a plurality of third registration members configured to snap-in to the spaced apart registration structures to thereby couple the frameless protective shutter assembly to the cover assembly.

42. The assembly of claim 30, wherein the frameless protective shutter assembly further comprises:

the first shutter member including an elongated slot disposed along a transverse axis of the shutter assembly;

the second shutter member coupled to the first shutter member, the first shutter member and the second shutter member being movable relative to each other to effect the open position only if both the first shutter member and the second shutter member are simultaneously engaged by the hot plug blade and the neutral plug blade; and a third shutter member disposed in the slot, the third shutter member being operable in conjunction with the second member to block a T-slot receptacle opening in the cover assembly in the closed position.

43. The assembly of claim 42, wherein the second shutter includes a cam member configured to engage the third shutter member, the cam member being configured to urge the third shutter member in a first direction along the transverse axis to cover a portion of the T-slot in the closed position.

44. The assembly of claim 43, wherein the third shutter member includes a ramp portion configured to engage a portion of the neutral plug blade, the neutral plug blade being configured to move the third shutter member in a second direction along the transverse axis as the first shutter member and the second shutter member move relative to each other to effect the open position.

45. The assembly of claim 44, wherein the first shutter member includes a first hot contact aperture and a neutral contact aperture, and the second shutter member includes a second hot contact aperture.

46. The assembly of claim 45, wherein the first shutter member and the second shutter member are movable relative to each other from the closed position to the open position in response to being simultaneously engaged by the hot plug blade and the neutral plug blade such that the first hot contact aperture is aligned with the second hot contact aperture and the neutral contact aperture is unblocked by the second shutter member.

47. The assembly of claim 30, further comprising:

a fault detection circuit at least partially disposed on a circuit board, the fault detection circuit being configured to detect the at least one fault condition and provide a fault detect signal in response thereto; and interrupting contacts coupled to the fault detection circuit and disposed between the line terminals and the at least one receptacle, the interrupting contacts being configured to disconnect the power source from the at least one receptacle in response to receiving the fault detect signal.

48. The assembly of claim 47, wherein the fault detection circuit includes a miswire circuit, the miswiring circuit being configured to actuate the protective shutter assembly from a locked state to an unlocked state in response to detecting a proper wiring condition, the locked state being configured to lock the protective shutter assembly in the closed position.

49. The assembly of claim 47, wherein the fault detection circuit is configured to detect a ground fault condition, a grounded neutral condition, or an arc fault condition.

50. The assembly of claim 30, wherein the electrical wiring device includes a transient voltage surge suppressor (TVSS).

51. The assembly of claim 30, wherein the electrical wiring device includes at least one switch.

52. The assembly of claim 30, wherein the electrical wiring device includes a lighting device.

53. The assembly of claim 52, wherein the lighting device includes a night light.

54. The assembly of claim 30, wherein the assembly includes a raceway structure.

55. The assembly of claim 30, wherein the electrical wiring device includes a power adapter device.

56. The assembly of claim 30, wherein the at least one set of receptacle openings includes an opening configured to accommodate a plug ground contact blade, the assembly further comprising a ground shutter assembly coupled to the protective shutter assembly and configured to prevent the protective shutter assembly from moving from the closed position to the open position unless the ground shutter assembly is engaged by the plug ground contact blade.

57. The assembly of claim 30, wherein the spring member is the only spring element in the protective shutter assembly.

58. A method for assembling an electrical wiring device, the method comprising:

providing an electrical wiring device having a cover assembly including at least one set of receptacle openings configured to accommodate a set of plug blades having a predetermined plug blade geometry, the cover assembly also including at least one cover registration structure;

providing a frameless protective shutter assembly including a first shutter member and a second shutter member configured to move from a closed position to an open position in response to engaging the set of plug blades, a spring member coupled to the first shutter member and the second shutter member, the frameless protective shutter assembly including at least one retainer element configured to retain the spring member within the frameless protective shutter assembly, the frameless protective shutter assembly also including at least one shutter assembly registration member;

positioning the frameless protective shutter assembly within the cover assembly; and coupling the at least one shutter assembly registration member to the at least one cover registration structure, the frameless protective shutter assembly being disposed within the cover assembly in substantial alignment with the at least one set of receptacle openings.

59. The method of claim 58, wherein the step of positioning is automated.

60. The method of claim 59, wherein the step of positioning includes feeding the frameless protective shutter assembly from a bulk part storage facility to an automated assembly tool.

61. The method of claim 60, wherein the bulk storage facility includes a vibratory bowl feeder configured to accommodate a plurality of protective shutter assemblies.

62. The method of claim 60, wherein the step of coupling includes disposing the protective shutter assembly in the cover assembly using the automated assembly tool.

* * * * *